US008177321B2

(12) United States Patent
Tsuchiya et al.

(10) Patent No.: US 8,177,321 B2
(45) Date of Patent: May 15, 2012

(54) IMAGE FORMING APPARATUS, IMAGE FORMING SYSTEM AND NON-TRANSITORY COMPUTER-READABLE STORAGE MEDIUM HAVING FUNCTION TO DRIVE TRANSPORT BELT BASED ON CHARGE LEAK

(75) Inventors: Tomokazu Tsuchiya, Kanagawa (JP); Takafumi Shimizu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 314 days.

(21) Appl. No.: 12/692,683

(22) Filed: Jan. 25, 2010

(65) Prior Publication Data

US 2010/0194795 A1 Aug. 5, 2010

(30) Foreign Application Priority Data

Feb. 3, 2009 (JP) ..... 2009-023047
Feb. 3, 2009 (JP) ..... 2009-023048

(51) Int. Cl.
*B41J 29/393* (2006.01)

(52) U.S. Cl. ..... 347/19; 347/14; 347/104

(58) Field of Classification Search ..... 347/14, 347/19, 20, 101, 104
See application file for complete search history.

(56) References Cited

U.S. PATENT DOCUMENTS 6,857,802 B2 * 2/2005 Chino et al. ..... 400/635
2008/0225070 A1 9/2008 Morishita et al.
2009/0231367 A1 9/2009 Tsuchiya

FOREIGN PATENT DOCUMENTS

JP 2004-351682 12/2004
JP 2005-231814 9/2005
JP 2006-016111 1/2006

* cited by examiner

*Primary Examiner* — Juanita D Jackson
(74) *Attorney, Agent, or Firm* — IPUSA, PLLC

(57) ABSTRACT

An image forming apparatus includes a voltage applying unit to apply a voltage to and charge a surface of transport belt, a leak judging unit to judge a charge leak on the surface of the transport belt, and a recovery operation unit to perform a charge leak recovery operation in which the transport belt is driven in a state where the voltage applying unit applies no voltage to the transport belt, if the leak judging unit judges that the charge leak is generated on the surface of the transport belt. The leak judging unit again judges whether the charge leak is generated on the surface of the transport belt after the recovery operation unit performs the charge leak recovery operation.

15 Claims, 18 Drawing Sheets

IMAGE FORMING APPARATUS, IMAGE FORMING SYSTEM AND NON-TRANSITORY COMPUTER-READABLE STORAGE MEDIUM HAVING FUNCTION TO DRIVE TRANSPORT BELT BASED ON CHARGE LEAK

CROSS-REFERENCE TO RELATED APPLICATIONS

This application claims the benefit of Japanese Patent Applications No. 2009-023047 filed Feb. 3, 2009 and No. 2009-023048 filed Feb. 3, 2009, in the Japanese Patent Office, the disclosures of which are hereby incorporated by reference.

BACKGROUND OF THE INVENTION

1. Field of the Invention

The present invention generally relates to image forming apparatuses, image forming systems and storage media, and more particularly to an image forming apparatus and an image forming system that detect a leak on a transport belt, and to a computer-readable storage medium that stores a program which, when executed by a computer, causes the computer to detect the leak on the transport belt.

2. Description of the Related Art

A transport belt provides one method of transporting a recording medium, such as paper, placed thereon in an image forming apparatus, such as a printer. The surface of the transport belt is charged so that the recording medium placed thereon is electrostatically adhered thereon. However, if moisture exists in an area on the surface of the transport belt due to condensation, a relatively high current (or voltage) flows in this area when the transport belt is charged, to thereby generate a leak current (or short-circuit current) that causes a charge leak. Accordingly, a technique has been proposed to stop the operation of the printer when the leak current caused by moisture on the transport belt is detected.

On the other hand, a technique has been proposed to continue the print operation of the printer even when the charge leak occurs. For example, a Japanese Laid-Open Patent Publication No. 2005-231814 proposes not charging the area on the transport belt where the charge leak occurs in order to continue the print operation without causing damage to the printer.

However, when the leak current is detected in the conventional printers employing the above techniques, the leak current is recognized as an error (or abnormality). In other words, although the leak current may be generated by causes such as moisture on the transport belt, ink leak within the printer resulting in unwanted ink on the transport belt, and damage to the transport belt, the printer recognizes the leak current as an error regardless of the cause. The print operation of the printer is stopped when the error is recognized. For this reason, even if the detected leak current is generated by a cause such as moisture on the transport belt, which is recoverable by a relatively simple recovery process that may be performed by a user, for example, the detected leak current is processed as an error and the printer can no longer be used when the error is recognized. As a result, the printer cannot be used until a service person attends to the maintenance of the printer and removes the cause of the error.

SUMMARY OF THE INVENTION

Accordingly, it is a general object of the present invention to provide a novel and useful image forming apparatus, image forming system and computer-readable storage medium, in which the problems described above are suppressed.

Another and more specific object of the present invention is to provide an image forming apparatus, an image forming system and a computer-readable storage medium, configured to perform a recovery process when a leak current or a charge leak that is detected is generated by a recoverable cause.

According to one aspect of the present invention, there is provided an image forming apparatus comprising a transport belt configured to transport a recording medium on a surface thereof when driven; a voltage applying unit configured to apply a voltage to the transport belt and to charge the transport belt; a leak judging unit configured to judge a charge leak on the surface of the transport belt; and a recovery operation unit configured to perform a charge leak recovery operation in which the transport belt is driven in a state where the voltage applying unit applies no voltage to the transport belt, if the leak judging unit judges that the charge leak is generated on the surface of the transport belt, wherein the leak judging unit again judges whether the charge leak is generated on the surface of the transport belt after the recovery operation unit performs the charge leak recovery operation.

According to one aspect of the present invention, there is provided an image forming system comprising an information processing apparatus and the image forming apparatus described above, coupled via a network or the like.

According to one aspect of the present invention, there is provided a computer-readable storage medium storing a program which, when executed by a computer, causes the computer to perform a process in an image forming apparatus comprising a transport belt configured to transport a recording medium on a surface thereof when driven, said process comprising a voltage applying procedure applying a voltage to the transport belt and charging the transport belt; a leak judging procedure judging a charge leak on the surface of the transport belt; and a recovery operation procedure performing a charge leak recovery operation in which the transport belt is driven in a state where the voltage applying procedure applies no voltage to the transport belt, if the leak judging procedure judges that the charge leak is generated on the surface of the transport belt, wherein the leak judging procedure again judges whether the charge leak is generated on the surface of the transport belt after the recovery operation procedure performs the charge leak recovery operation.

Other objects and further features of the present invention will be apparent from the following detailed description when read in conjunction with the accompanying drawings.

DESCRIPTION OF THE PREFERRED EMBODIMENTS

Figure 1:
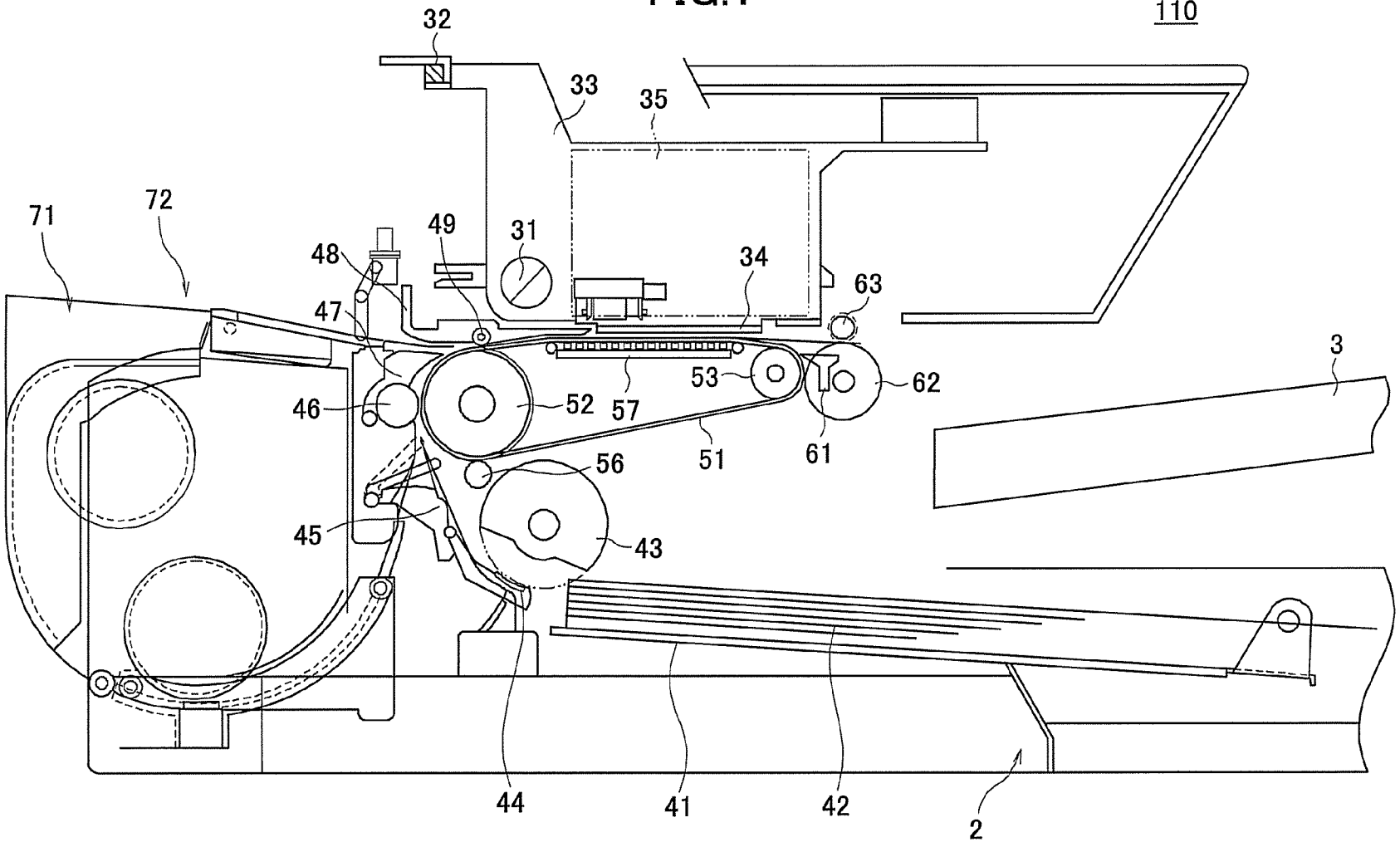
FIG. 1 is a side view, in partial cross section, illustrating a part of an image forming apparatus in a first embodiment of the present invention.

A description will be given of embodiments of an image forming apparatus, an image forming system and a computer-readable storage medium, by referring to the drawings.

First Embodiment

Figure 2:
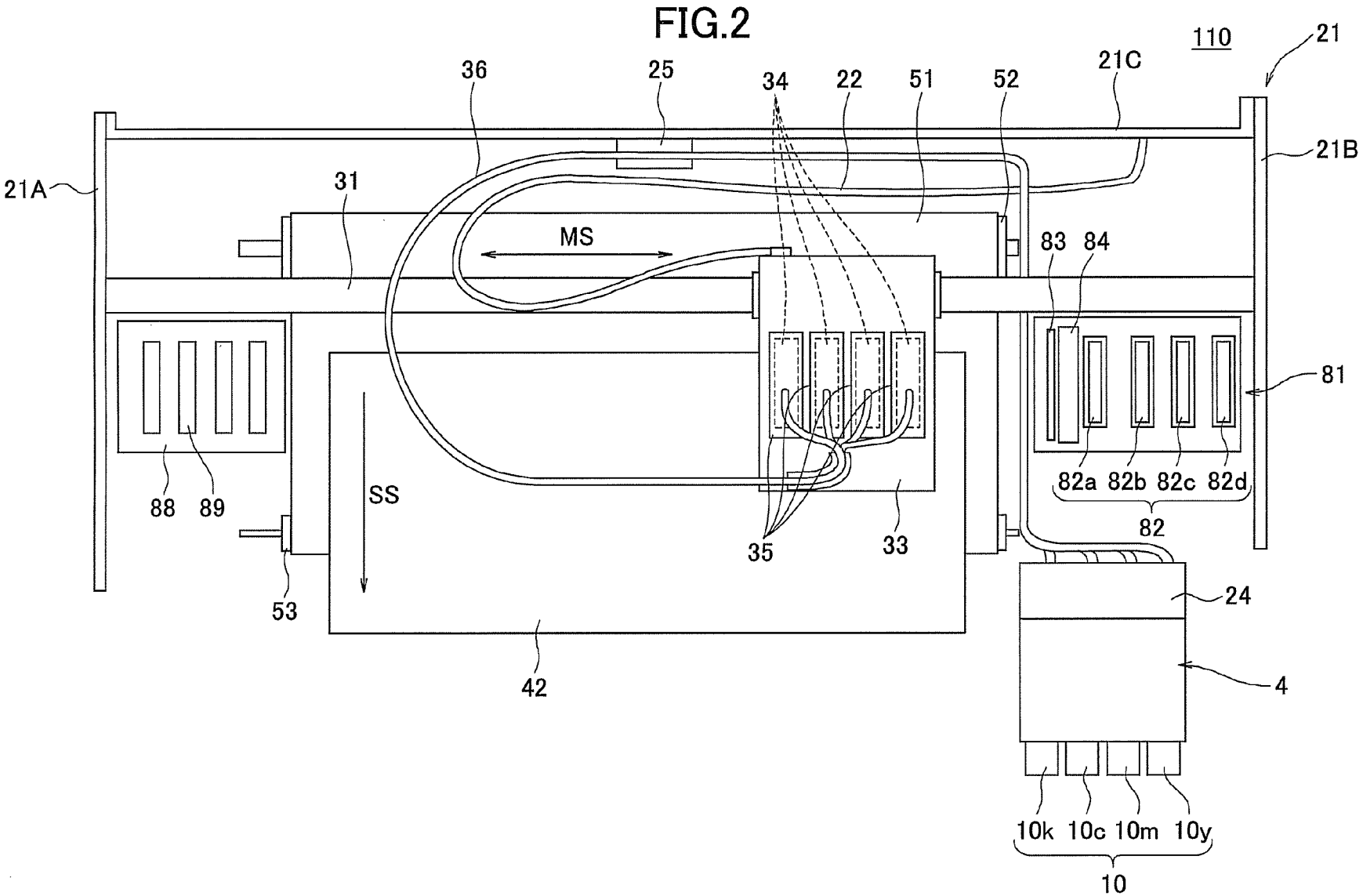
FIG. 2 is a plan view illustrating a part of the image forming apparatus.

A description will be given of the image forming apparatus in a first embodiment of the present invention, by referring to FIGS. 1 and 2. FIG. 1 is a side view, in partial cross section, illustrating a part of the image forming apparatus in the first embodiment, and FIG. 2 is a plan view illustrating a part of the image forming apparatus in the first embodiment. In the first embodiment, the present invention is applied to an ink-jet recording apparatus (or printer) 110. For the sake of convenience, the illustration of some parts of the ink-jet recording apparatus 110 is omitted in FIGS. 1 and 2 because the basic structure of the ink-jet recording apparatus 110 may be formed by a known structure.

As illustrated in FIG. 2, the ink-jet recording apparatus 110 includes a frame 21 that is formed by side plates 21A and 21B and a back plate 210. A guide rod 31 and a stay 32 illustrated in FIG. 1 are provided across the side plates 21A and 21. A carriage 33 is slidably supported by the guide rod 31 and the stay 32 and is movable in a carriage moving direction, that is, a main scan direction MS in FIG. 2. The carriage 33 is moved in the main scan direction MS by a known driving mechanism (not illustrated) including a main scan motor and a timing belt.

A recording head 34 is provided on the carriage 33. The recording head 34 includes four ink-jet heads for jetting yellow (Y), cyan (C), magenta (M) and black (Bk) inks, respectively. Each ink-jet head has a plurality of nozzles for jetting the ink drops. The nozzles of each ink-jet head are arranged in a medium transport direction, that is, a sub scan direction SS which is perpendicular to the main scan direction. MS. The nozzles of each ink-jet head jets the ink drops downwards in FIG. 1.

Each ink-jet head of the recording head 34 includes a pressure generating mechanism (or pressure generating means) that generates pressure to be applied on the ink to cause jetting of the ink drops. The pressure generating mechanism may be formed by a piezoelectric actuator such as a piezoelectric element or, an electro-thermal conversion element such as a heating resistor or, a shape-memory alloy actuator that uses a metal phase change caused by a temperature change or, an electrostatic actuator that uses electrostatic force, and the like.

The nozzles of all of the ink-jet heads may be driven simultaneously or, driven time-divisionally. In the former case, the image recording quality may deteriorate due to crosstalk among the nozzles, and the capacity of a power supply needs to be relatively large in order to temporarily supply a relatively high voltage. On the other hand, in the latter case, the crosstalk among the nozzles may be suppressed and the capacity of the power supply may be reduced.

A driver Integrated Circuit (IC, not illustrated) is mounted on the recording head 34, and this driver IC is connected to a controller (not illustrated) of the ink-jet recording apparatus 110 via a Flexible Printed Circuit (FPC) 22.

Sub tanks 35 for supplying the Y, M, C and Bk inks to the recording head 34 are mounted on the carriage 33. The sub tanks 35 for supplying the Y, M, C and Bk inks are connected to corresponding ink cartridges 10*y*, 10*m*, 10*c* and 10*k* storing the Y, M, C and Bk inks, via ink supply tubes 36. The ink cartridges 10*y*, 10*m*, 10*c* and 10*k*, forming an ink cartridge part 10, are set in a cartridge loading part 4. The cartridge loading part 4 has a pump unit 24 for pumping the inks from the ink cartridge part 10 to the corresponding sub tanks 35. Intermediate portions of the ink supply tubes 36 are held on the back plate 21C by a holding member 25.

A medium tray 2 has a medium stacking part 41 on which recording media 42, such as paper, are stacked. The medium stacking part 41 is provided with a pressure applying part which pushes the stacked recording media 42 generally upwards in FIG. 1. A semicircular supply roller 43 separates and supplies the recording media 42, one recording medium 42 at a time, between the supply roller 43 and a separation pad 44 which opposes the supply roller 43. The separation pad 44 is made of a material having a relatively large coefficient of friction, and is urged towards the supply roller 43. The supply roller 43 and the separation pad 44 form a medium supply part.

A guide member 45, a counter roller 46, a transport guide member 47, and a pushing member 48 are provided in order to guide the recording medium 42 that is supplied from the medium supply part onto a transport belt 51 towards a confronting position under the recording head 34 in FIG. 1. The pushing member 48 has a pressing roller 49 on a tip end thereof to push the recording medium 42 against the transport belt 51. The recording medium 42 is electrostatically adhered on the surface of the transport belt 51 and transported to the confronting position under the recording head 34.

Figure 3:
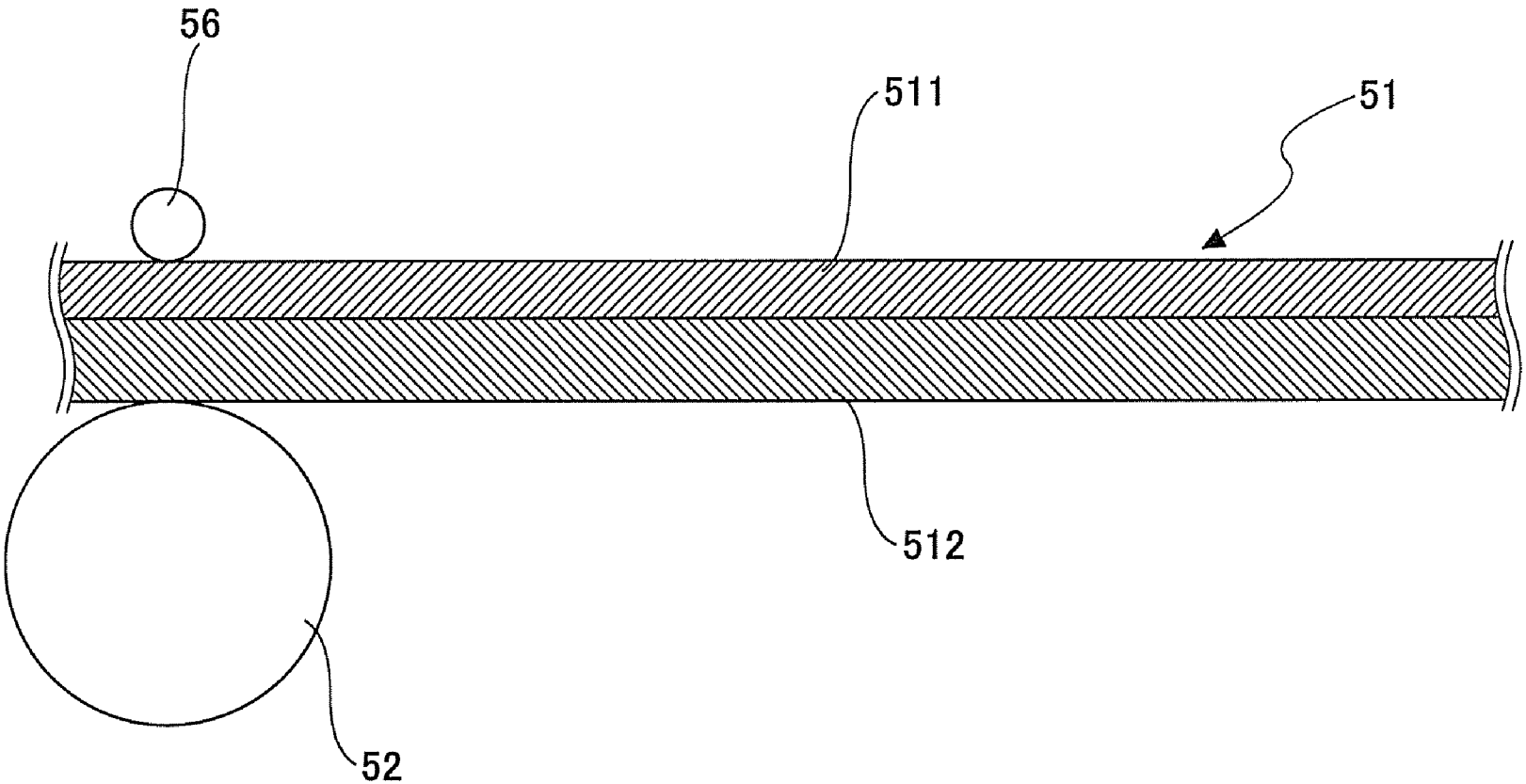
FIG. 3 is a diagram for explaining a transport belt of the image forming apparatus.

The transport belt 51 is formed by an endless belt arranged across a transport roller 52 and a tension roller 53, and is driven by a sub scan motor (not illustrated) to revolve in the medium transport direction, that is, the sub scan direction SS in FIG. 2. FIG. 3 is a diagram for explaining the transport belt 51. As illustrated in FIG. 3, the transport belt 51 includes a top surface layer 511 and a back surface layer 512. For example, the top surface layer 511 is made of a pure resin, such as an ETFE pure material which is a thermoplastic fluoropolymer comprised of tetrafluoroethylene ($C_2F_4$) and ethylene ($C_2H_4$), that is not subjected to a resistance control and has a thickness of approximately 40 μm, in order to form an insulator layer. The back surface layer 512 may be made of the same material as the top surface layer 511, but is subjected to a resistance control using carbon, for example, in order to form a ground layer having a medium resistance.

A charging roller 56 forms a charging unit (or charging means) that charges the surface of the transport belt 51, that is, the top surface layer 511. The charging roller 56 is arranged to make contact with the surface of the transport belt 51 and to rotate as the transport belt 51 revolves in a state where a pressure of 2.5 N, for example, is applied on a rotary shaft at both ends of the charging roller 51. The transport roller 52 is arranged to make contact with the back surface layer 512 of the transport belt 51, and also functions as a grounding roller.

A guide member 57 is arranged within the loop formed by the transport belt 51, at a position corresponding to a recording region of the recording head 34. A top surface of the guide member 57 in FIG. 1 projects towards the recording head 34 from a tangent of the transport roller 52 and the tension roller 53 which support the transport belt 51, in order to maintain a highly accurate planar state of the transport belt 51 within the recording region of the recording head 34.

The ink-jet recording apparatus 100 further includes a medium eject part that ejects the recording medium 42 which has been recorded images thereon by the recording head 34. The medium eject part includes a separation finger 61 for separating the recording medium 42 from the transport belt 51, and eject rollers 62 and 63. A medium eject tray 3 is provided under the eject roller 34 in FIG. 1. A certain distance is formed between a height position of the medium eject tray 3 and a point of contact between the eject rollers 62 and 63 in FIG. 1, in order to enable a certain amount of recording media 42 to be stacked on the eject tray 3.

A duplex unit 71 is detachably provided on a rear part of the ink-jet recording apparatus 110, corresponding to the left side in FIG. 1. The duplex unit 71 reverses the side of the recording medium 42 that is fed back and supplied thereto when the revolving direction of the transport belt 51 is reversed. The duplex unit 71 supplies the reversed recording medium 42 again to the position between the counter roller 46 and the transport belt 51. A manual medium supply tray 72 is provided on top of the duplex unit 71.

As illustrated in FIG. 2, a recovery mechanism 81 is provided in a non-recording region at one end (right side in this example) along the main scan direction MS of the carriage 33. The recovery mechanism 81 maintains the nozzles of the recording head 34 in a desired state by performing a recovery process to achieve the desired state if necessary. The recovery mechanism 81 includes a cap member part 82 formed by cap members 82*a* through 82*d* for capping the nozzle surfaces of each of the four heads forming the recording head 34, a wiper blade 83 for wiping the nozzle surfaces, and a receiving part 84 for receiving the ink jetted from the recording head 34 and not contributing to the recording when cleaning the recording head 34 to remove the unwanted ink with an increased viscosity sticking at the nozzles in a cleaning process performed during an idle state, a starting state or, a recording standby state of the ink-jet recording apparatus 110, for example. The cap member 82*a* may have functions to remove the unwanted ink jetted from the nozzles by suction and to maintain a desired wet state of the nozzles, while the other cap members 82*b* through 82*d* may have a function to maintain the desired wet state of the nozzles, for example.

The ink recovered by the recovery process of the recovery mechanism 81 includes the ink jetted into the cap member part 82 and the ink adhered on the wiper blade 83 by the wiping of the nozzle surface. This recovered ink is received by the receiving part 84 and ejected to a waste tank (not illustrated).

A receiving part 88 is provided in the non-recording region at the other end (left side in this example) along the main scan direction MS of the carriage 33 in FIG. 2. The receiving part 84 receives the ink jetted from the recording head 34 and not contributing to the recording when cleaning the recording head 34 to remove the unwanted ink with an increased viscosity sticking at the nozzles in a cleaning process performed during a recording process of the ink-jet recording apparatus 110, for example. The receiving part 88 includes a plurality of openings 89 provided at positions corresponding to the nozzles of the four heads forming the recording head 34.

A control circuit board (not illustrated) is provided in the rear part of the ink-jet recording apparatus 110. The control circuit board includes a communication circuit part (or interface part, not illustrated), such as a Universal Serial Bus (USB) device, for enabling data communication between the ink-jet recording apparatus 110 and a host unit (not illustrated), and the controller for controlling the operation of the entire ink-jet recording apparatus 110.

Therefore, the recording medium 42 is supplied one by one from the medium supply tray 2, and the recording medium 42 supplied approximately in a vertical direction in FIG. 1 is guided by the guide member 45 and transported between the transport belt 51 and the counter roller 46. The tip end of the recording medium 42 is then guided by the transport guide member 47, and the recording medium 42 is pushed against the transport belt 51 by the pressing roller 49 so that the transport direction thereof is changed by approximately 90 degrees.

Figure 5:
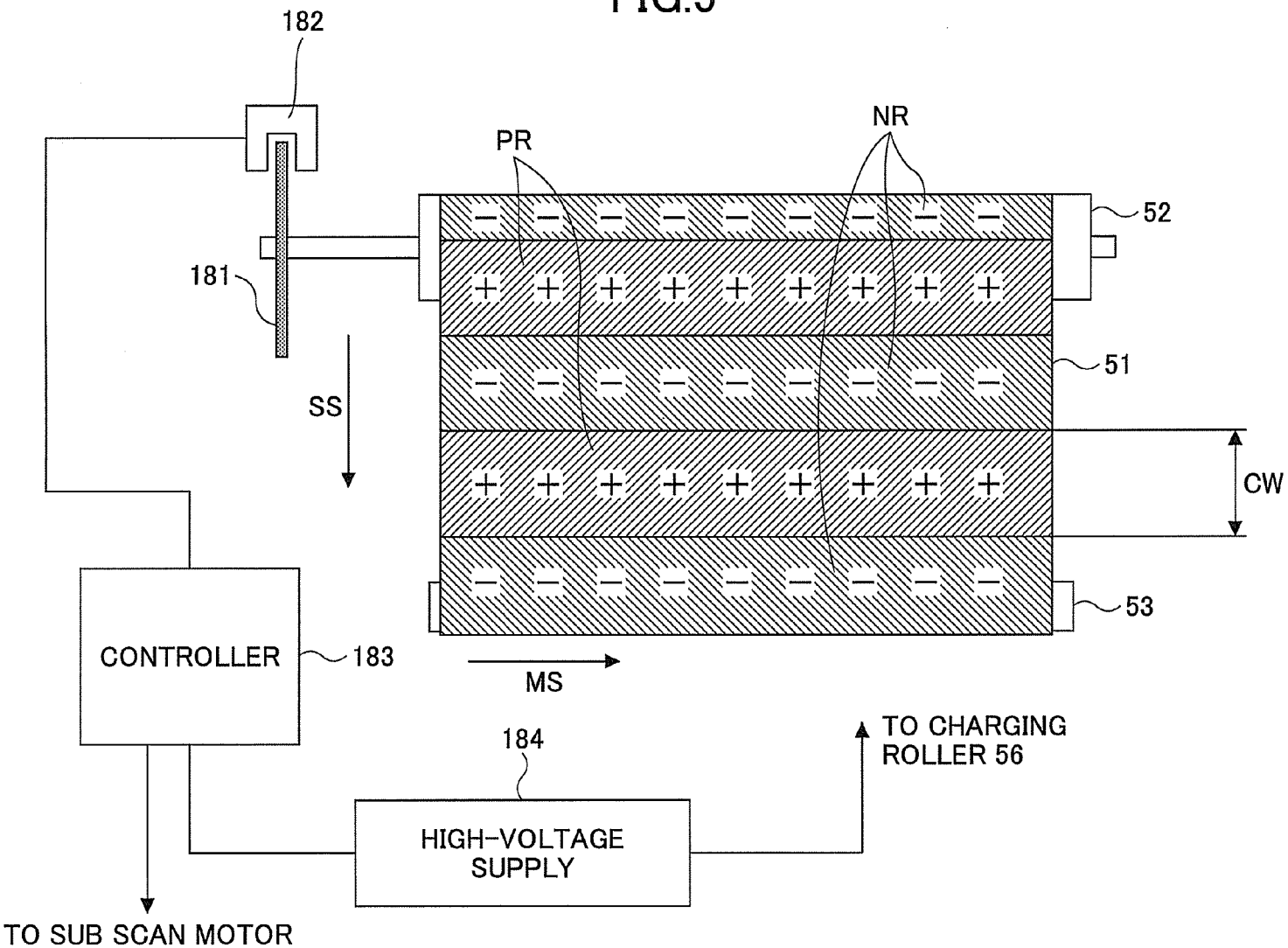
FIG. 5 is a diagram for explaining the transport belt and a high-voltage supply of the image forming apparatus.

The controller controls an AC bias supply part (not illustrated) to supply an AC bias voltage to the charging roller 56, and charge patterns with alternating polarities are formed on the transport belt 51 by the charging roller 56. Hence, as illustrated in FIG. 5 which will be described later, charge patterns of positive polarity extending along the main scan direction MS and charge patterns of negative polarity extending along the main scan direction MS are alternately formed on the surface of the transport belt 51 along the sub scan direction SS. When the recording medium 42 is transported onto the transport belt 51 which is charged in this manner, the recording medium 42 is electrostatically adhered on the surface of the transport belt 51, and the recording medium 42 is transported in the sub scan direction SS when the transport belt 51 revolves clockwise in FIG. 1.

Figure 4:
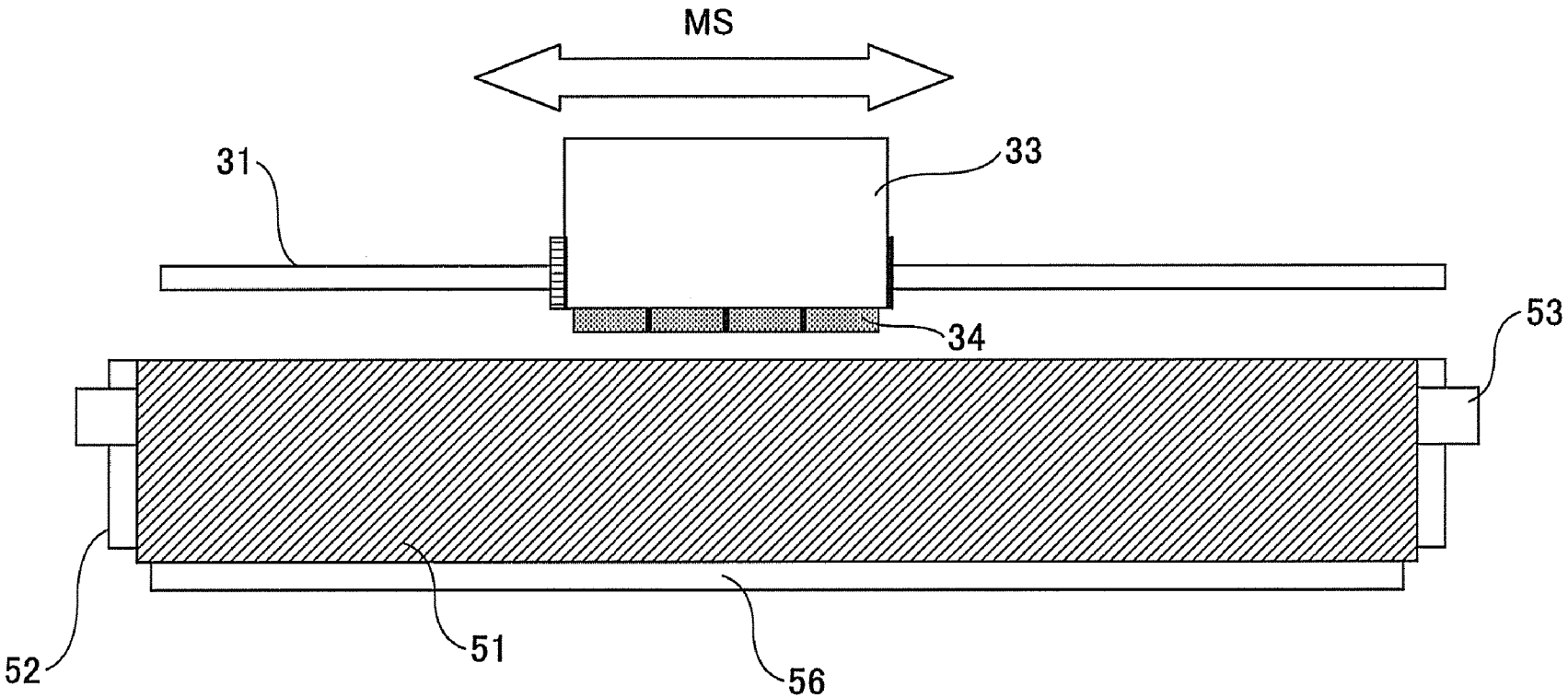
FIG. 4 is a diagram for explaining a positional relationship of the transport belt and a carriage mounted with a recording head relative to a main scan direction.

FIG. 4 is a diagram for explaining a positional relationship of the transport belt 51 and the carriage 33 mounted with the recording head 34 relative to the main scan direction MS. By driving the recording head 34 by an image signal while moving the carriage 33, it is possible to record one line, for example, by jetting ink drops onto the stationary recording medium 42 on the transport belt 51. The next line is recorded after transporting the recording medium 42 in the sub scan direction SS by one line. Upon receipt of a recording end signal or a signal indicating that a trailing end of the recording medium 42 is reached, the controller ends the recording process and the recording medium 42 is ejected onto the medium eject tray 3.

In the recording standby state (or print standby state), for example, the carriage 33 is moved towards the recovery mechanism 81, and the recording head 34 is capped by the cap member part 82. Hence, the nozzles of the recording head 34 are maintained in a desired wet state, and an unstable ink-jet caused by hardening or drying of the ink is prevented. In the recovery process, a suction pump (not illustrated) sucks the ink from the nozzles capped by the cap member part 82, in order to remove the unwanted ink with the increased viscosity or air bubbles within the ink. The ink not contributing to the recording is jetted from the nozzles before the start of the recording or during the recording, so that the stable ink-jet performance of the recording head 34 can be maintained.

Figure 6:
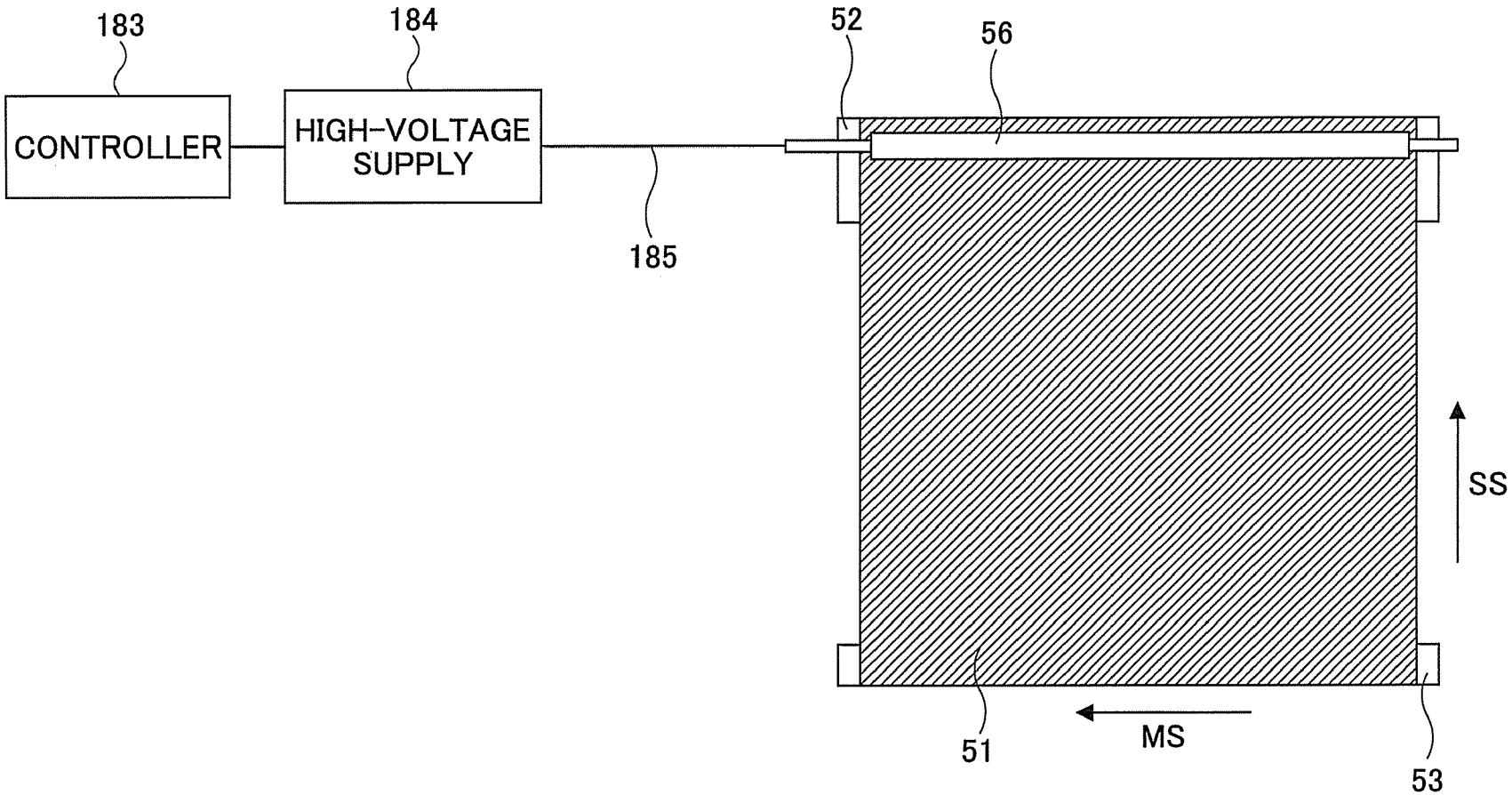
FIG. 6 is a diagram for explaining the transport belt and the high-voltage supply of the image forming apparatus.

Next, a description will be given of the transport belt 51 and a high-voltage supply, by referring to FIGS. 5 and 6. FIGS. 5 and 6 are diagrams for explaining the transport belt 51 and the high-voltage supply.

FIG. 5 is a plan view of the transport belt 51 to illustrate a charging width CW thereon taken along the sub scan direction SS, and FIG. 6 is a bottom view of the transport belt 51. The charge patterns of positive polarity extending along the main scan direction MS, and charge patterns of negative polarity extending along the main scan direction MS each having the charging width CW along the sub scan direction SS, and are alternately formed on the surface of the transport belt 51 along the sub scan direction SS. In FIG. 5, PR denotes regions charged to positive polarity, and NR denotes regions charged to negative polarity.

In FIG. 5, an encoder 181 is fixed to the rotary shaft of the transport roller 52. When the transport roller 52 rotates as the transport belt 51 is driven by the sub scan motor to revolve, a sensor 182 reads the rotary position of the encoder 181 and outputs a position signal to a controller 183 corresponding to the controller described above. Hence, the controller 183 controls the sub scan motor in response to the position signal in order to cause the transport belt 51 to revolve at a desired speed. On the other hand, the controller 183 controls a high-voltage supply 184 to output the AC voltage having a relatively high voltage that is applied to the charging roller 56 via a high-voltage cable 185 illustrated in FIG. 6. For example, the AC voltage output from the high-voltage supply 184 has a rectangular waveform.

Figure 7:
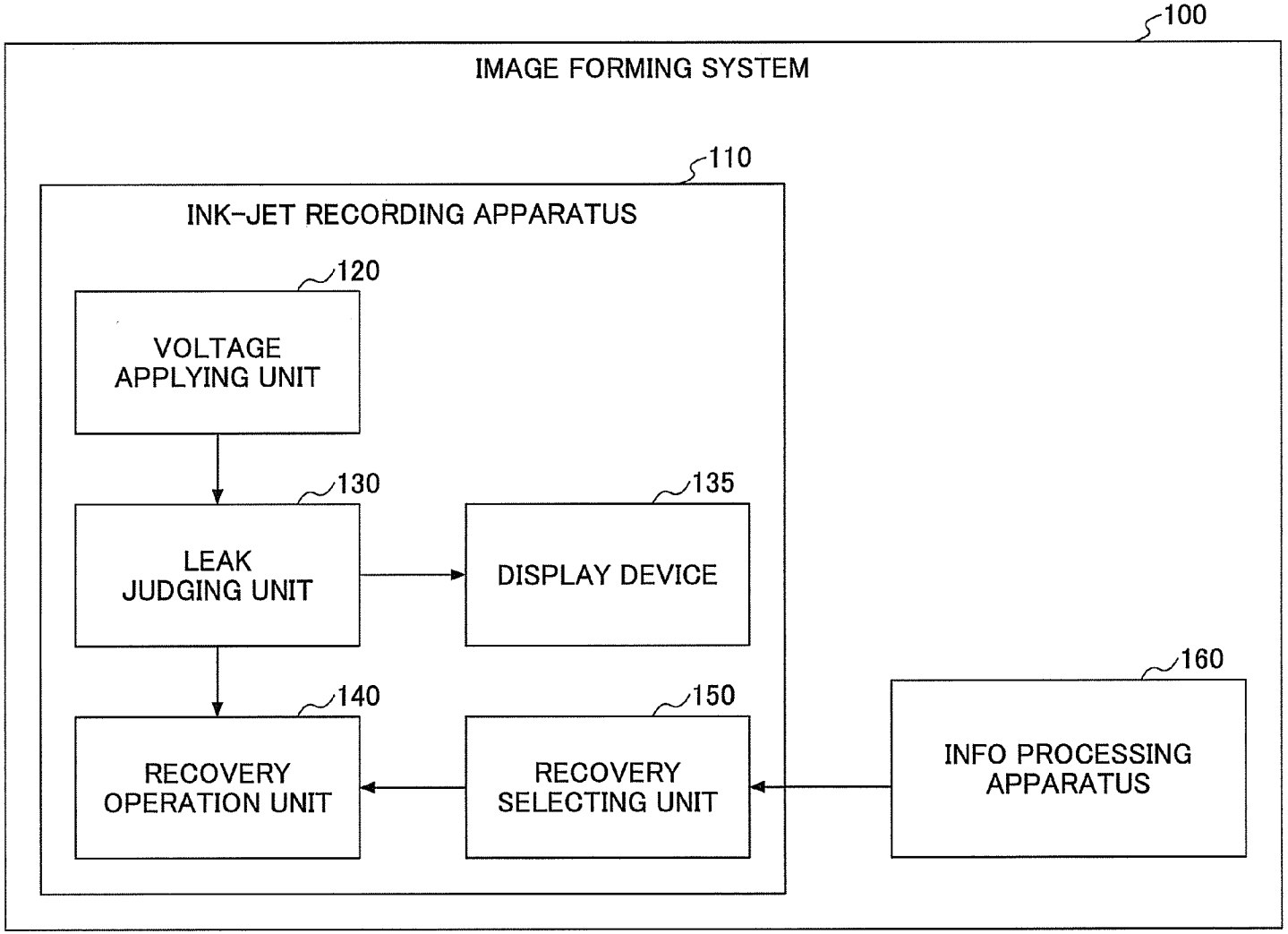
FIG. 7 is a functional block diagram illustrating an image forming system in the first embodiment of the present invention.

FIG. 7 is a functional block diagram illustrating an image forming system in this first embodiment of the present invention. An image forming system 100 illustrated in FIG. 7 includes the ink-jet recording apparatus 110 and an information processing apparatus 160. The ink-jet recording apparatus 110 includes a voltage applying unit 120, a leak judging unit 130, a display device 135, a recovery operation unit 140, and a recovery selecting unit 150. The voltage applying unit 120 may be formed by the controller 183 which controls the high-voltage supply 184. The leak judging unit 130 may be formed by the controller 183 which detects a charge leak on the surface of the transport belt 51 by detecting an amount of current flowing in the high-voltage supply 184 and detecting a current leak if the amount of current exceeds a predetermined threshold value, for example. The display device 135 may form an operation panel (not illustrated) of the ink-jet recording apparatus 110. For example, the display device 135 may be formed by a touch-panel that functions as both a display device and an input device to form the operation panel. The recovery operation unit 140 may be formed by the controller 183 which carries out a control to appropriately control the operation of the recovery mechanism 81 and the receiving part 88. The recovery selecting unit 150 may be formed by the controller 183 which accepts a selection from the user on whether a charge leak recovery operation is to be performed. This selection from the user may be made from the operation panel or, from the information processing apparatus 160. The information processing apparatus 160 forms the host unit which may be formed by a general-purpose computer, including a processor such as a Central Processing Unit (CPU), a storage unit such as a memory, an input device such as a keyboard, and a display device.

The information processing apparatus 160 may send a print job execution request with respect to the ink-jet recording apparatus 110. In this case, the ink-jet recording apparatus 110 carries out the print job, that is, a recording process, in response to the print job execution request.

[First Example of Process]

Figure 8:
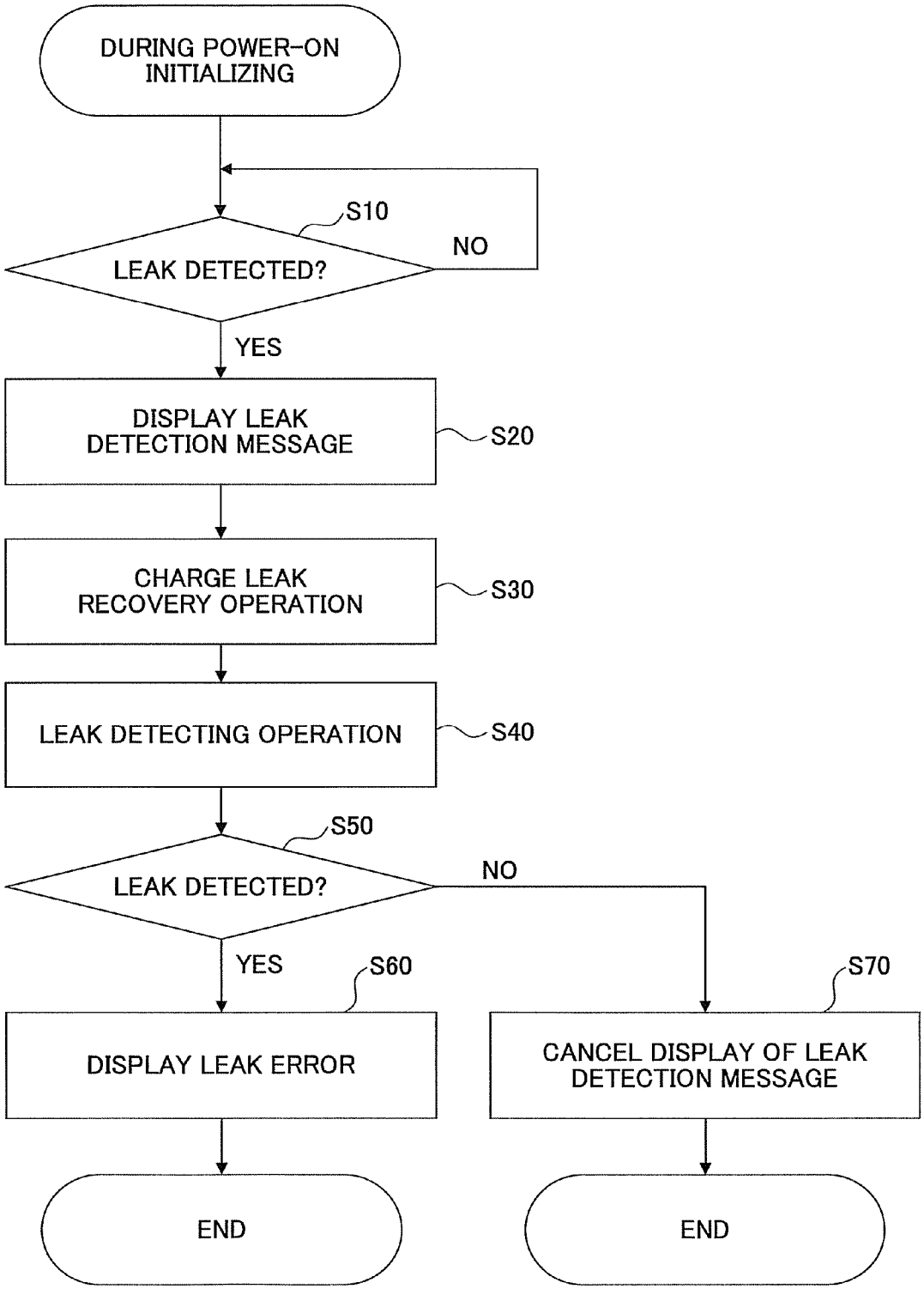
FIG. 8 is a flow chart for explaining a first example of the process of the image forming apparatus in the first embodiment.

FIG. 8 is a flow chart for explaining a first example of the process of the ink-jet recording apparatus 110 in this first embodiment. This first example of the process is performed when the charge leak on the surface of the transport belt 51 is detected during a power-ON initialization process of the ink-jet recording apparatus 110.

In a step S10 illustrated in FIG. 8, during the power-ON initialization process, the voltage applying unit 120 controls the high-voltage supply 184 to output the AC voltage having the relatively high voltage that is applied to the charging roller 56 in order to charge the surface of the transport belt 51, and the leak judging unit 130 judges whether the charge leak is generated on the surface of the transport belt 51. During the power-ON initialization process, the leak judging unit 130 controls the sub scan motor in order to revolve the transport belt 51 by a predetermined amount in the state where the surface of the transport belt 51 is charged, and checks the amount of current flowing in the high-voltage supply 184, to thereby perform a leak detecting operation. If moisture exists in an area on the surface of the transport belt 51 due to condensation, for example, and a charge leak is generated in this area, a relatively large current will flow in the high-voltage supply 184. Hence, the leak judging unit 130 can judge from the leak detecting operation that the charge leak is generated on the surface of the transport belt 51 if the amount of current flowing in the high-voltage supply 184 exceeds the predetermined threshold value.

If the judgement result in the step S10 becomes YES and the process advances to a step S20, the leak judging unit 130 displays on the display device 135 a leak error message, with respect to the user, indicating that the charge leak has been detected and that a charge leak recovery operation will be performed.

In a step S30, the recovery operation unit 140 carries out a charge leak recovery operation, including controlling the sub scan motor to revolve the transport belt 51 for a predetermined time or, by a predetermined amount, in a state where the surface of the transport belt 51 is not charged. During the power-ON initialization process of the ink-jet recording apparatus 110, no recording medium 42 is supplied onto the transport belt 51. For this reason, the recovery operation unit 140 can perform the charge leak recovery operation immediately after the leak judging unit 130 judges that the charge leak is generated on the surface of the transport belt 51.

In a step S40, the leak judging unit 140 performs the leak detecting operation again, because the charge leak will not be eliminated by performing the charge leak recovery operation if the transport belt 51 is physically damaged, for example. If the charge leak is detected and the judgement result in a step S50 becomes YES, the operation advances to a step S60, and the leak judging unit 130 displays on the display device 135 a leak error message, with respect to the user, indicating that a charge leak (or leak error) has been detected, and stops the operation of the ink-jet recording apparatus 110. The operation of the ink-jet recording apparatus 110 needs to be stopped when the leak error is detected the second time, because a normal recording process cannot be performed using the transport belt 51 that is physically damaged, for example. On the other hand, if the judgement result in the step S50 is NO, the process advances to a step S70, and the leak judging unit 130 cancels the leak error message displayed on the display device 135, and puts the ink-jet recording apparatus 110 to the recording standby state.

[Second Example of Process]

Figure 9:
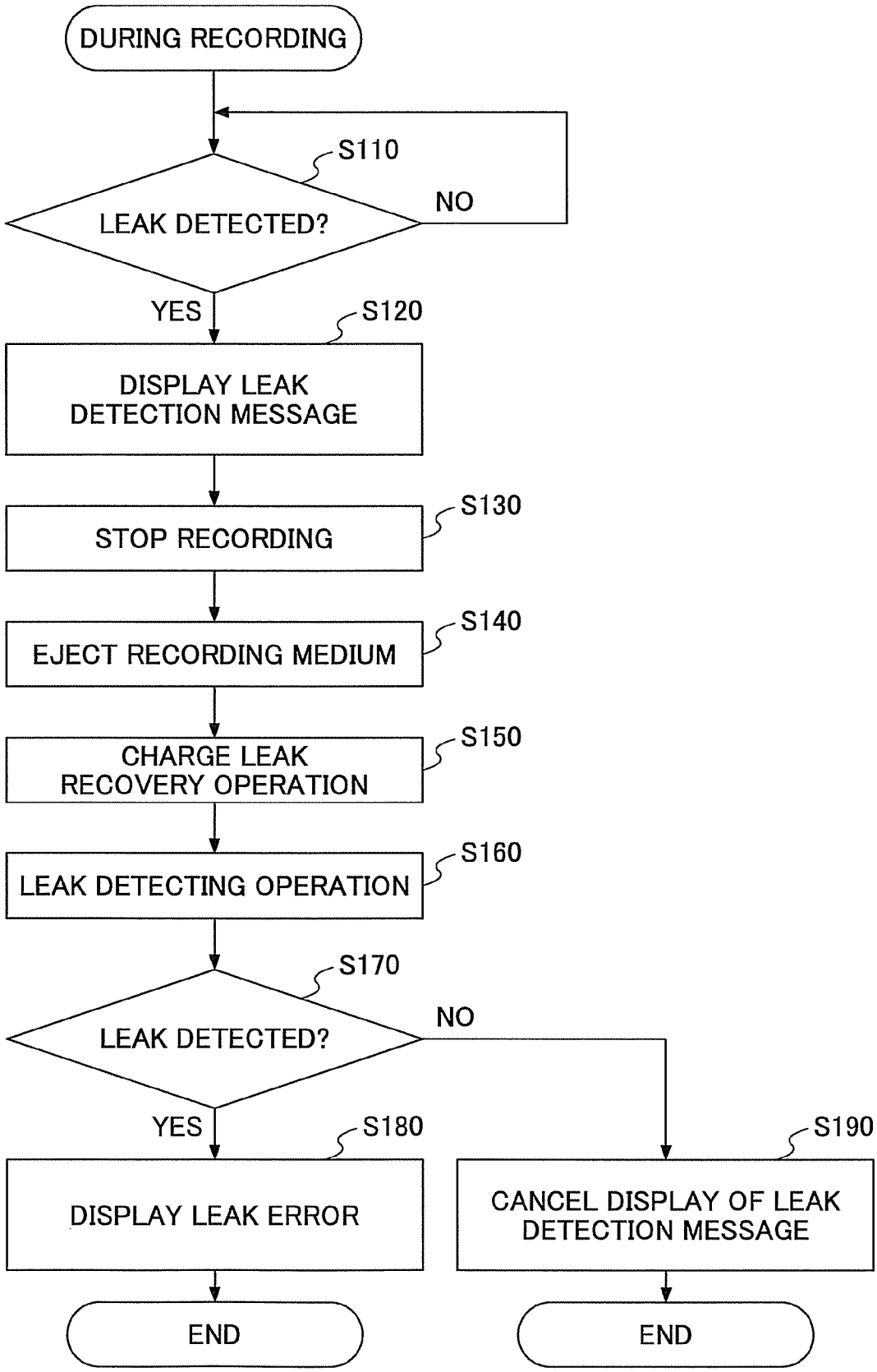
FIG. 9 is a flow chart for explaining a second example of the process of the image forming apparatus in the first embodiment.

FIG. 9 is a flow chart for explaining a second example of the process of the ink-jet recording apparatus 110 in this first embodiment. This second example of the process is performed when the charge leak on the surface of the transport belt 51 is detected during the recording process of the ink-jet recording apparatus 110.

In a step S110 illustrated in FIG. 9, during the recording process, the voltage applying unit 120 controls the high-voltage supply 184 to output the AC voltage having the relatively high voltage that is applied to the charging roller 56 in order to charge the surface of the transport belt 51, and the leak judging unit 130 judges whether the charge leak is generated on the surface of the transport belt 51. During the recording process, the leak judging unit 130 checks the amount of current flowing in the high-voltage supply 184, to thereby perform a leak detecting operation. If moisture exists in an area on the surface of the transport belt 51 due to condensation, for example, and a charge leak is generated in this area, a relatively large current will flow in the high-voltage supply 184. Hence, the leak judging unit 130 can judge from the leak detecting operation that the charge leak is generated on the surface of the transport belt 51 if the amount of current flowing in the high-voltage supply 184 exceeds the predetermined threshold value.

If the judgement result in the step S110 becomes YES and the process advances to a step S120, the leak judging unit 130 displays on the display device 135 a leak error message, with respect to the user, indicating that the charge leak has been detected and that a charge leak recovery operation will be performed.

In a step S130, the leak judging unit 130 stops the recording process of the ink-jet recording apparatus 110. In a step S140, the recovery operation unit 140 controls the sub scan motor and the like to eject the recording medium 42 remaining on the transport belt 51 onto the medium eject tray 3.

In a step S150, the recovery operation unit 140 carries out a charge leak recovery operation, including controlling the sub scan motor to revolve the transport belt 51 for a predetermined time or, by a predetermined amount, in a state where the surface of the transport belt 51 is not charged.

In a step S160, the leak judging unit 140 performs the leak detecting operation again, because the charge leak will not be eliminated by performing the charge leak recovery operation if the transport belt 51 is physically damaged, for example. If the charge leak is detected and the judgement result in a step S170 becomes YES, the operation advances to a step S180, and the leak judging unit 130 displays on the display device 135 a leak error message, with respect to the user, indicating that a charge leak (or leak error) has been detected, and stops the operation of the ink-jet recording apparatus 110. The operation of the ink-jet recording apparatus 110 needs to be stopped when the leak error is detected the second time, because a normal recording process cannot be performed using the transport belt 51 that is physically damaged, for example. On the other hand, if the judgement result in the step S170 is NO, the process advances to a step S190, and the leak judging unit 130 cancels the leak error message displayed on the display device 135, and controls the ink-jet recording apparatus 110 to resume the recording process.

[Third Example of Process]

Figure 10:
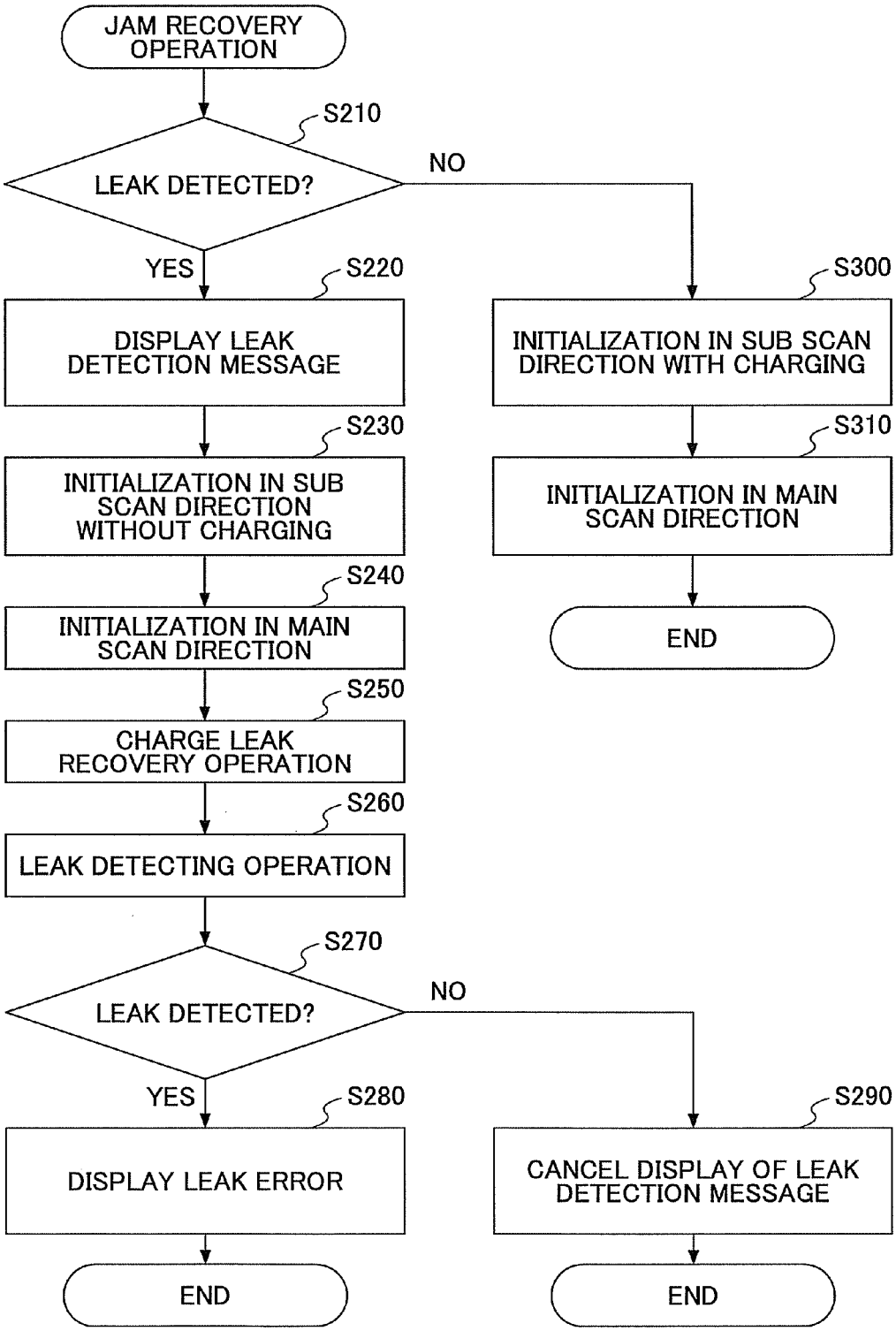
FIG. 10 is a flow chart for explaining a third example of the process of the image forming apparatus in the first embodiment.

FIG. 10 is a flow chart for explaining a third example of the process of the ink-jet recording apparatus 110 in this first embodiment. This third example of the process is performed when the charge leak on the surface of the transport belt 51 is detected during a power-ON initialization process of the ink-jet recording apparatus 110 when making a jam recovery process.

In a normal jam recovery process, the initialization process is performed for both the main scan direction MS and the sub scan direction SS. In other words, for the main scan direction MS, the recording head 34 moves to the right and left in FIG. 2 in order to check for foreign objects or particles within the ink-jet recording apparatus 110, and a maintenance operation is thereafter carried out with respect to the recording head 34. On the other hand, for the sub scan direction SS, the transport belt 51 is revolved by a predetermined amount in the state where the surface of the transport belt 51 is charged, the recording medium 42 remaining on the transport belt 51 is ejected onto the medium eject tray 3, and a leak detecting operation is performed to check if a charge leak is generated.

In a step S210 illustrated in FIG. 10, the leak judging unit 130 judges whether the charge leak is generated on the surface of the transport belt 51. If the judgement result in the step S210 becomes YES and the process advances to a step S220, the leak judging unit 130 displays on the display device 135 a leak error message, with respect to the user, indicating that the charge leak has been detected. During the jam recovery process, one or more recording media 42 may remain in a medium transport path within the ink-jet recording apparatus 110, including the transport belt 51. For this reason, if the charge leak recovery operation is performed in the state where the recording medium 42 remains in the medium transport path, a medium jam (or paper jam) may occur within the ink-jet recording apparatus 110 and cause further troubles.

For this reason, when the charge leak is generated during the jam recovery process and the judgement result in the step S210 is YES, steps S230 and S240 are carried out by the recovery operation unit 140 after the step S220. In other words, the step S230 performs a predetermined initialization process for the sub scan direction SS by revolving the transport belt 51 by a predetermined amount at a relatively low speed, for example, in the state where the surface of the transport belt 51 is not charged and the recording medium 42 remaining on the transport belt 51 is ejected onto the medium eject tray 3. Further, the step S240 performs the initialization process for the main scan direction MS. Thereafter, the recovery operation unit 140 performs a charge leak recovery operation in a step S250, and the leak judging unit 140 performs the leak detecting operation again in a step S260. If the charge leak is detected and the judgement result in the step S270 becomes YES, the operation advances to a step S280, and the leak judging unit 130 displays on the display device 135 a leak error message, with respect to the user, indicating that a charge leak (or leak error) has been detected. On the other hand, if the judgement result in the step S270 is NO, the process advances to a step S290, and the leak judging unit 130 cancels the leak error message displayed on the display device 135, and puts the ink-jet recording apparatus 110 in the recording standby state.

If the judgement result in the step S210 is NO, the process advances to a step S300, and the step S300 and a step S310 are performed to carry out the normal jam recovery process. More particularly, the step S300 performs the initialization process for the sub scan direction SS, and the step S310 performs the initialization process for the main scan direction MS.

[Fourth Example of Process]

Figure 11:
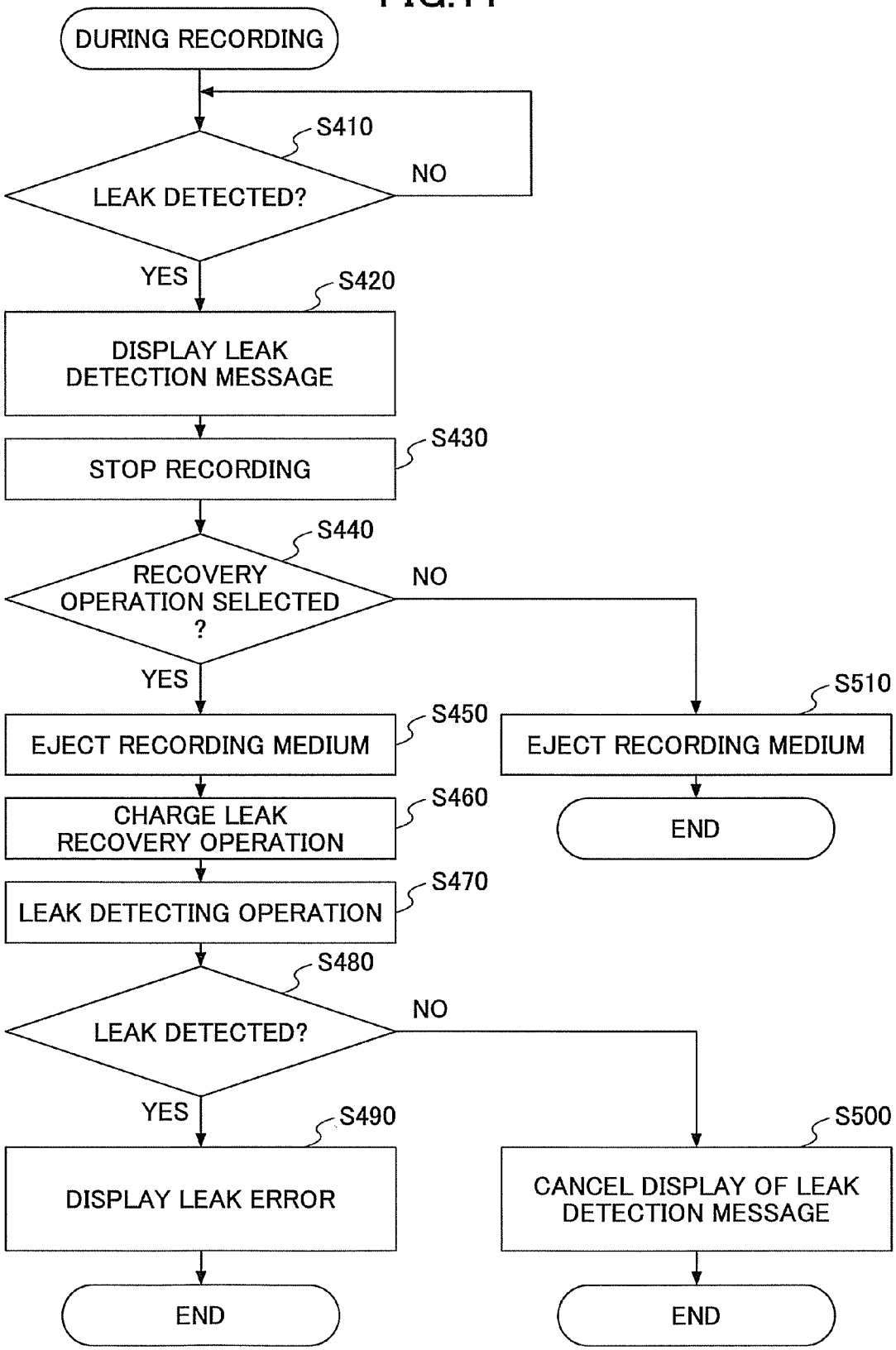
FIG. 11 is a flow chart for explaining a fourth example of the process of the image forming apparatus in the first embodiment.

FIG. 11 is a flow chart for explaining a fourth example of the process of the ink-jet recording apparatus 110 in this first embodiment. This fourth example of the process is performed when the charge leak on the surface of the transport belt 51 is detected during the recording process of the ink-jet recording apparatus 110. When the charge leak caused by a recoverable cause such as condensation is detected, the ink-jet recording apparatus 110 can resume operation by performing the charge leak recovery operation. On the other hand, when the detected charge leak is caused by a non-recoverable cause such as ink adhered on the transport belt 51 due to ink leak, the ink-jet recording apparatus 110 cannot resume operation even after performing the charge leak recovery operation. Accordingly, in this fourth example of the process, the ink-jet recording apparatus 110 accepts a selection made by the user on whether the charge leak recovery operation is to be performed.

The ink-jet recording apparatus 110 is performing the recording process when a step S410 illustrated in FIG. 11 is carried out. In the step S410, the voltage applying unit 120 controls the high-voltage supply 184 to output the AC voltage having the relatively high voltage that is applied to the charging roller 56 in order to charge the surface of the transport belt 51, and the leak judging unit 130 judges whether the charge leak is generated on the surface of the transport belt 51.

If the judgement result in the step S410 becomes YES and the process advances to a step S420, the leak judging unit 130 displays on the display device 135 a leak error message, with respect to the user, indicating that the charge leak has been detected and that a charge leak recovery operation will be performed. In a step S430, the leak judging unit 130 stops the recording process of the ink-jet recording apparatus 110.

In a step S440, the recovery selecting unit 150 accepts a selection from the user indicating whether the charge leak recovery operation is to be performed, if any, and judges whether the charge leak recovery operation is selected. The process advances to a step S450 if the judgement result in the step S440 is YES, and the process advances to a step S510 if the judgement result in the step S440 is NO.

The selection from the user indicating whether the charge leak recovery operation is to be performed may be made from the information processing apparatus 160 and input to the ink-jet recording apparatus 110 via a communication network, for example. In this case, the selection may be made on a printer driver screen displayed on the display device of the information processing apparatus 160, by checking a check box on the screen or making a selection on a pull-down menu on the screen. Of course, the step S440 may judge whether to accept the selection from the user, depending on various conditions such as the mode of operation of the ink-jet recording apparatus 110 and the source (that is, the information processing apparatus 160 or the ink-jet recording apparatus 110) which made the selection, for example.

In the step S450, the recovery operation unit 140 controls the sub scan motor and the like to eject the recording medium 42 remaining on the transport belt 51 onto the medium eject tray 3.

In a step S460, the recovery operation unit 140 carries out a charge leak recovery operation by controlling the sub scan motor to revolve the transport belt 51 for a predetermined time or, by a predetermined amount, in a state where the surface of the transport belt 51 is not charged.

In a step S470, the leak judging unit 140 performs the leak detecting operation again, after the charge leak recovery operation, because the charge leak will not be eliminated by performing the charge leak recovery operation if the transport belt 51 is physically damaged, for example. If the charge leak is detected and the judgement result in a step S480 becomes YES, the operation advances to a step S490, and the leak judging unit 130 displays on the display device 135 a leak error message, with respect to the user, indicating that a charge leak (or leak error) has been detected, and stops the operation of the ink-jet recording apparatus 110. On the other hand, if the judgement result in the step S480 is NO, the process advances to a step S500, and the leak judging unit 130 cancels the leak error message displayed on the display device 135, and controls the ink-jet recording apparatus 110 to resume the recording process.

If the judgement result in the step S440 is NO and the process advances to the step S510, the recovery operation unit 140 controls the sub scan motor and the like to eject the recording medium 42 remaining on the transport belt 51 onto the medium eject tray 3.

Second Embodiment

When the recovery operation unit 140 carries out a charge leak recovery operation, the transport belt 51 revolves for a predetermined time or, by a predetermined amount, in a state where the surface of the transport belt 51 is not charged, in order to remove the moisture on the transport belt 51. For this reason, the user who is unfamiliar with the charge leak recovery operation may think that the ink-jet recording apparatus 110 is carrying out an erroneous operation when the transport belt 51 revolves during the charge leak recovery operation, and decide to open a cover or lid to find out the cause of the erroneous operation. But this opening of the cover or lid of the ink-jet recording apparatus 110 will trigger an automatic stopping of the operation of the ink-jet recording apparatus 110 in most cases for safety reasons.

Accordingly, if the user mistakenly opens the cover or lid of the ink-jet recording apparatus 110 during the charge leak recovery operation, the charge leak recovery effect deteriorates, the charge leak recovery operation is delayed, and the reliability of the ink-jet recording apparatus 110 deteriorates.

Next, a description will be given of a second embodiment of the present invention which aims to further improve the charge leak recovery effect and the efficiency of the charge leak recovery operation.

The ink-jet recording apparatus 110 in this second embodiment has the basic structure described above for the first embodiment, and illustration and description of the basic structure of the ink-jet recording apparatus 110 will be omitted.

Figure 12:
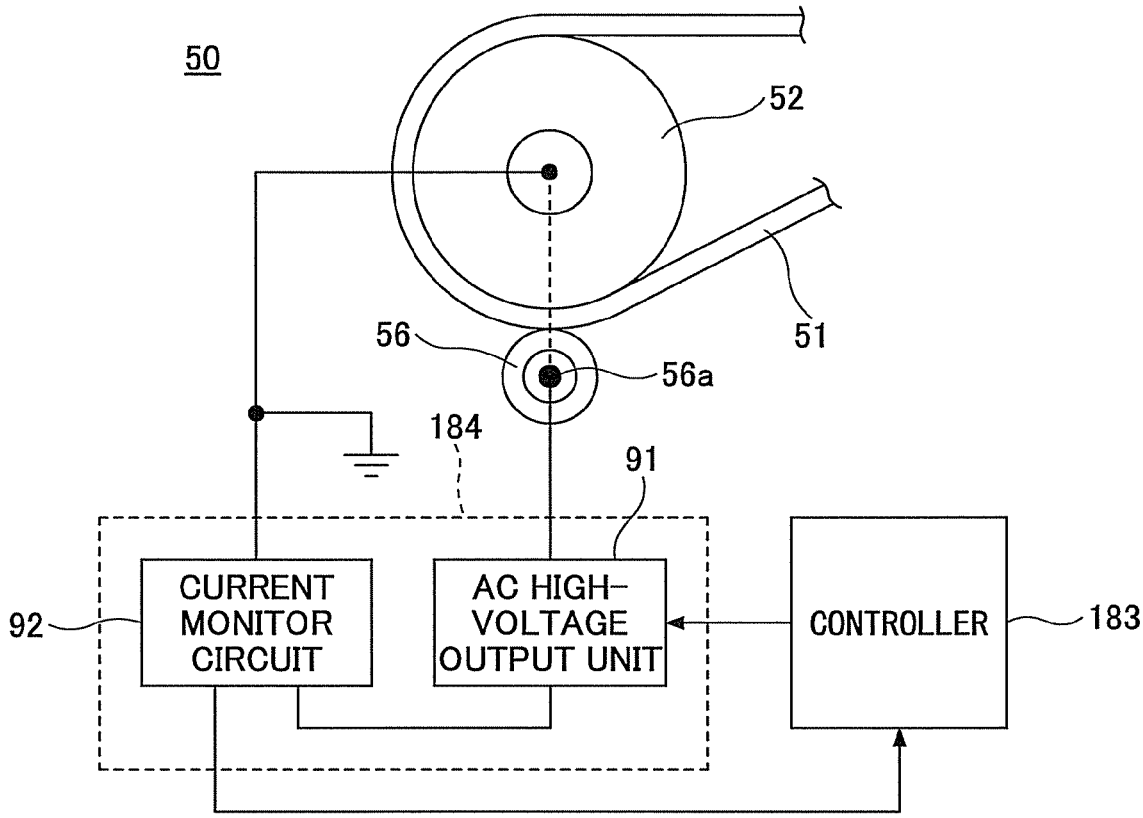
FIG. 12 is a diagram for explaining a method of detecting a charge leak on the transport belt in a second embodiment of the present invention.

FIG. 12 is a diagram for explaining a method of detecting a charge leak on the transport belt 51 in this second embodiment of the present invention. A transport unit 50 illustrated in FIG. 12 includes the controller 183 and the high-voltage supply 184. The high-voltage supply 184 includes a current monitor circuit 92 for detecting a charge leak on the surface of the transport belt 51, and an AC high-voltage output unit 91. The controller 183 functions as a leak position detecting part (or leak position detecting means) for detecting a leak position of the charge leak on the transport belt 51 detected by the current monitor circuit 92, and a voltage interrupting part (or voltage interrupting means) for stopping the AC high-voltage output unit 91 from outputting the high-voltage at a timing corresponding to the leak position detected by the current monitor circuit 92 if the charge leak is detected by the current monitor circuit 92.

In the AC high-voltage output unit 91, the high-voltage supply 184 applies the high-voltage to a rotary shaft **56*a* of the charging roller 56 in order to charge the surface of the transport belt 51. The current monitor circuit 92 detects the charge leak when the AC high-voltage output unit 91 applies the high-voltage to the rotary shaft 56***a*, by monitoring a current flowing through a closed circuit including the AC high-voltage output unit 91, the charging roller 56, the transport belt 51, the transport roller 52 and the current monitor circuit 92. The current flowing through the closed circuit increases when the charge leak is generated on the transport belt 51. Hence, the current monitor circuit 92 outputs a leak detection signal, indicating that the charge leak is generated on the transport belt 51, if the current flowing through the closed circuit exceeds a predetermined threshold value.

For example, if ink adheres to an area on the surface of the transport belt 51, the impedance decreases at this area in which the ink is adhered. In this case, the decrease in the impedance causes the current flowing through the closed circuit to increase. On the other hand, if the surface of the transport belt 51 is damaged, the impedance decreases at a damaged portion of the transport belt 51. Hence, the decrease in the impedance at the damaged portion of the transport belt 51 causes the current flowing through the closed circuit to increase. Furthermore, if foreign objects or particles, including paper powder and moisture due to condensation, adhere on the surface of the transport belt 51, the current flowing through the closed circuit similarly increases.

Accordingly, the current monitor circuit 92 uses an electronic circuit including transistors, resistors and Pulse Width Modulation control ICs (PWM-ICs), to detect both the positive and negative polarity currents, with respect to the high AC voltage output from the AC high-voltage output unit 91. The high AC voltage (or pulse voltage having positive and negative polarities) output from the AC high-voltage output unit 91 is applied to the transport belt 51 via the charging roller 56 (or rotary shaft 56*a*), and the positive and negative polarity charges are alternately applied to the transport belt 51 along the sub scan direction as described above in conjunction with FIG. 5. Hence, the recording medium 42 is stably and electrostatically adhered on the alternately charged surface of the transport belt 51. For this reason, when detecting the charge leak by applying the high AC voltage to the transport belt 51, a charge leak may not be detected if only the positive or negative polarity current is detectable. However, in this example, both the positive and negative polarity currents are detectable by the current monitor circuit 92, and thus, the charge leak can be positively detected.

Figure 13:
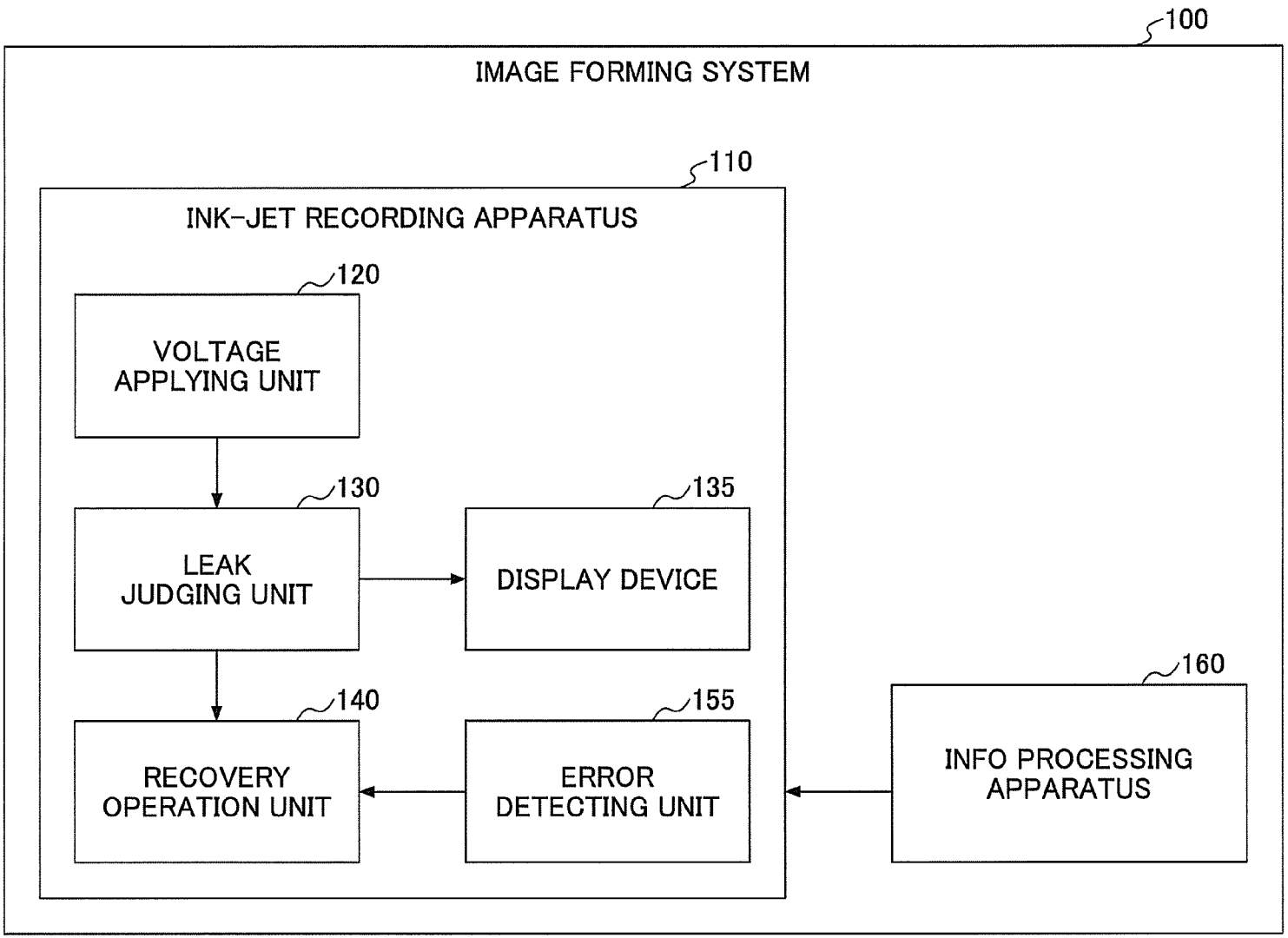
FIG. 13 is a functional block diagram illustrating the image forming system in the second embodiment of the present invention.

FIG. 13 is a functional block diagram illustrating the image forming system in this second embodiment of the present invention. In FIG. 13, those parts that are the same as those corresponding parts in FIG. 7 are designated by the same reference numerals, and a description thereof will be omitted.

The ink-jet recording apparatus 110 illustrated in FIG. 13 includes an error detecting unit 155 detecting an error state of the ink-jet recording apparatus 110. For example, the error detecting unit 155 may detect the error state of the ink-jet recording apparatus 110 by a known method, such as using a sensor (not illustrated) to detect the open or closed state of a lid or cover (not illustrated) of the ink-jet recording apparatus 110, and detecting the error state if the sensor detects the open state of the lid or cover.

[First Example of Process]

Figure 14:
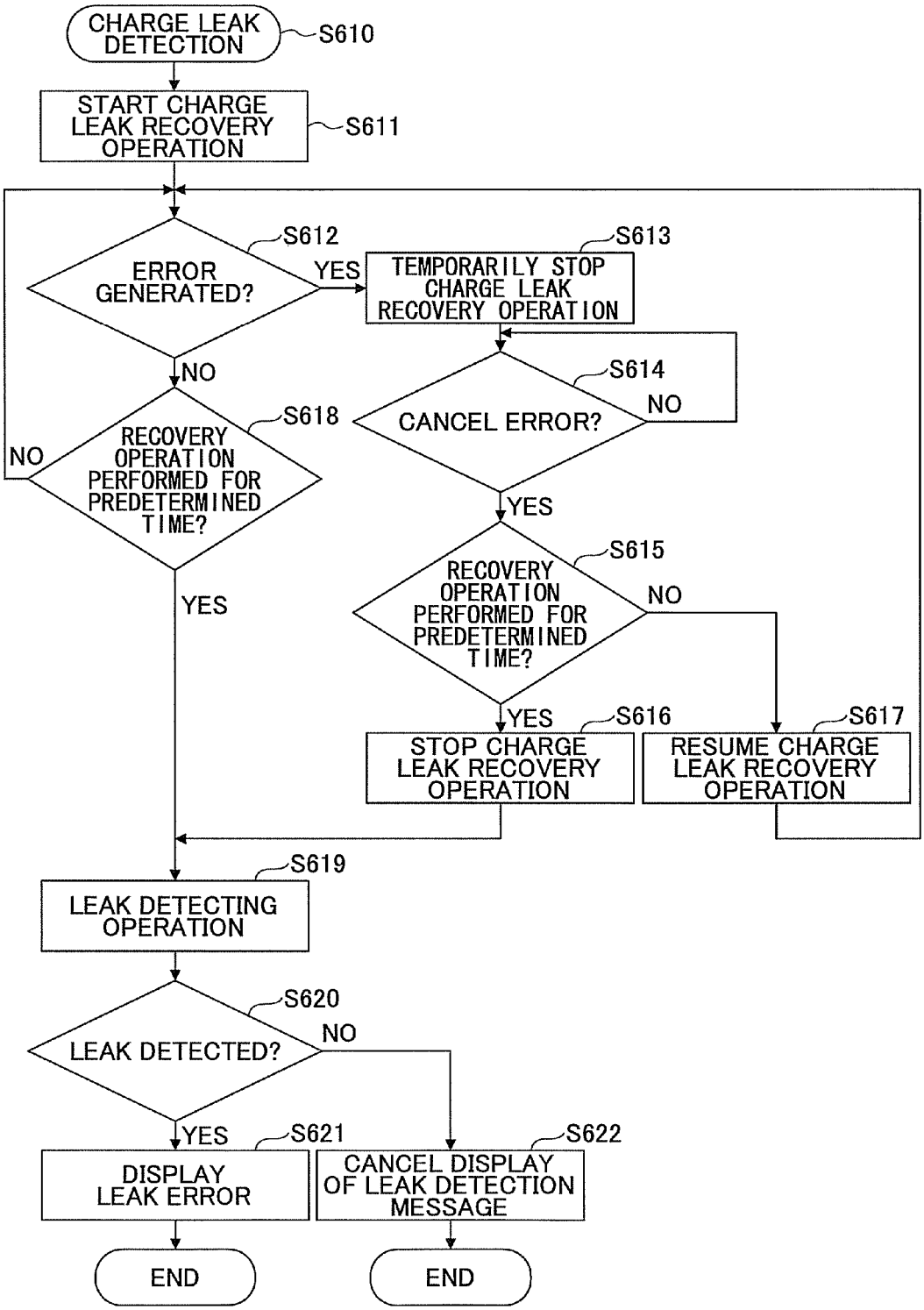
FIG. 14 is a flow chart for explaining a first example of the process of the image forming apparatus in the second embodiment.

FIG. 14 is a flow chart for explaining a first example of the process of the ink-jet recording apparatus 110 in this second embodiment. This first example of the process does not perform the charge leak recovery operation after an error generated during the charge leak recovery operation is recovered.

In a step S610 illustrated in FIG. 14, the voltage applying unit 120 controls the high-voltage supply 184 to output the AC voltage having the relatively high voltage that is applied to the charging roller 56 in order to charge the surface of the transport belt 51, and the leak judging unit 130 judges whether the charge leak is generated on the surface of the transport belt 51, similarly to the step S10 illustrated in FIG. 8. If the leak judging unit 130 detects the charge leak in the step S610, the process advances to a step S611, and the leak judging unit 130 displays on the display device 135 a leak error message, with respect to the user, indicating that the charge leak has been detected and that a charge leak recovery operation will be performed, similarly to the step S20 illustrated in FIG. 8, and starts the charge leak recovery process similarly to the step S30 illustrated in FIG. 8. The charge leak recovery operation may include controlling the sub scan motor to revolve the transport belt 51 for a predetermined time or, by a predetermined amount, in a state where the surface of the transport belt 51 is not charged.

In a step S612, the error detecting unit 155 judges whether an error state of the ink-jet recording apparatus 110 is detected. In this example, the error state may be detected if the sensor detects the open state of the lid or cover. If the judgement result in the step S612 is YES, the process advances to a step S613 and the recovery operation unit 140 temporarily stops the charge leak recovery operation. The process advances to a step S628 if the judgement result in the step S612 is NO.

In a step S614, the error detecting unit 155 judges whether the error state has been eliminated, and waits until the error state is eliminated and the judgement result in the step S614 becomes YES. In a step S615, the recovery operation unit 140 judges whether the charge leak recovery operation has been performed for a predetermined time or more before the error state was detected in the step S612. If the judgement result in the step S615 is YES, the process advances to a step S616 and the recovery operation unit 140 stops the charge leak recovery operation. The process advances to a step S619 after the step S616. On the other hand, if the judgement result in the step S615 is NO, the process advances to a step S617, and the recovery operation unit 140 resumes the charge leak recovery operation. The process returns to the step S612 after the step S617. If the predetermined time used in the step S615 is set to "0", the setting prohibits the charge leak recovery operation to be resumed after the error state is eliminated.

If the judgement result in the step S612 is NO, the process advances to a step S618 and the recovery operation unit 140 judges whether the charge leak recovery operation has been performed for a predetermined time or more. The process returns to the step S612 if the judgement result in the step S618 is NO. If the judgement result in the step S618 is YES, the process advances to the step S619 and the leak judging unit 130 performs a leak detecting operation, similarly to the step S30 illustrated in FIG. 8, in order to detect the charge leak if any.

In a step S620, the leak judging unit 130 judges whether the charge leak is detected again. If the charge leak is detected and the judgement result in the step S620 becomes YES, the operation advances to a step S621, and the leak judging unit 130 displays on the display device 135 a leak error message, with respect to the user, indicating that a charge leak (or leak error) has been detected, and stops the operation of the ink-jet recording apparatus 110. On the other hand, if the judgement result in the step S620 is NO, the process advances to a step S622, and the leak judging unit 130 cancels the leak error message displayed on the display device 135, and puts the ink-jet recording apparatus 110 to the recording standby state. Hence, the steps S618 through S622 are similar to the steps S30, S40, S50, S60 and S70 illustrated in FIG. 8.

[Second Example of Process]

Figure 15:
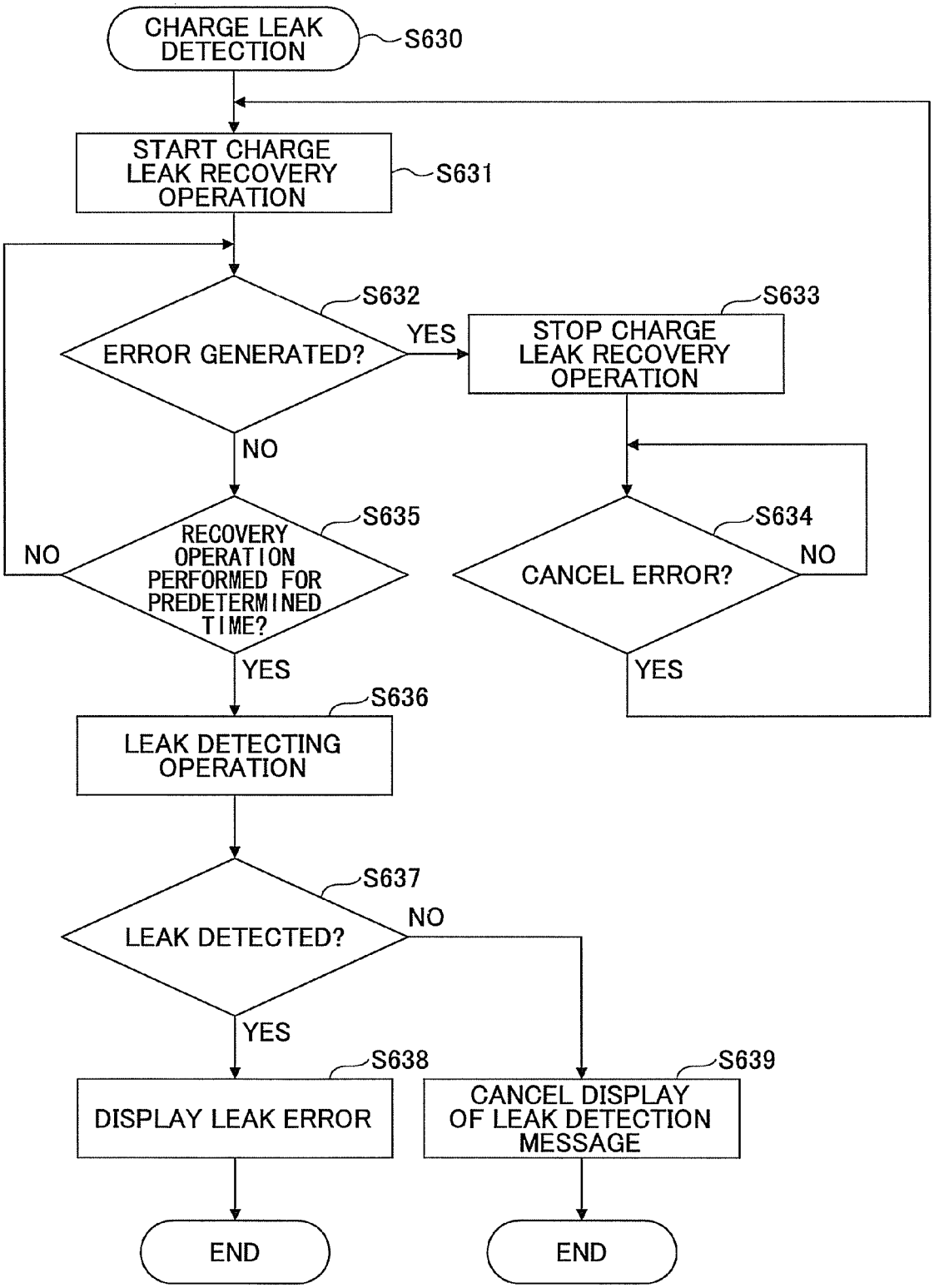
FIG. 15 is a flow chart for explaining a second example of the process of the image forming apparatus in the second embodiment.

FIG. 15 is a flow chart for explaining a second example of the process of the ink-jet recording apparatus 110 in this second embodiment. This second example of the process performs the charge leak recovery operation over again from the start after an error generated during the charge leak recovery operation is recovered.

In FIG. 15, steps S630 through S634 correspond to the steps S610 through S614 illustrated in FIG. 14, and a description thereof will be omitted. In FIG. 15, the process returns to the step S631 to restart the charge leak recovery operation if the judgement result in the step S634 is YES.

Steps S635 through S639 illustrated in FIG. 15 correspond to the steps S618 through S622 illustrated in FIG. 14, and a description thereof will be omitted.

[Third Example of Process]

Figure 16:
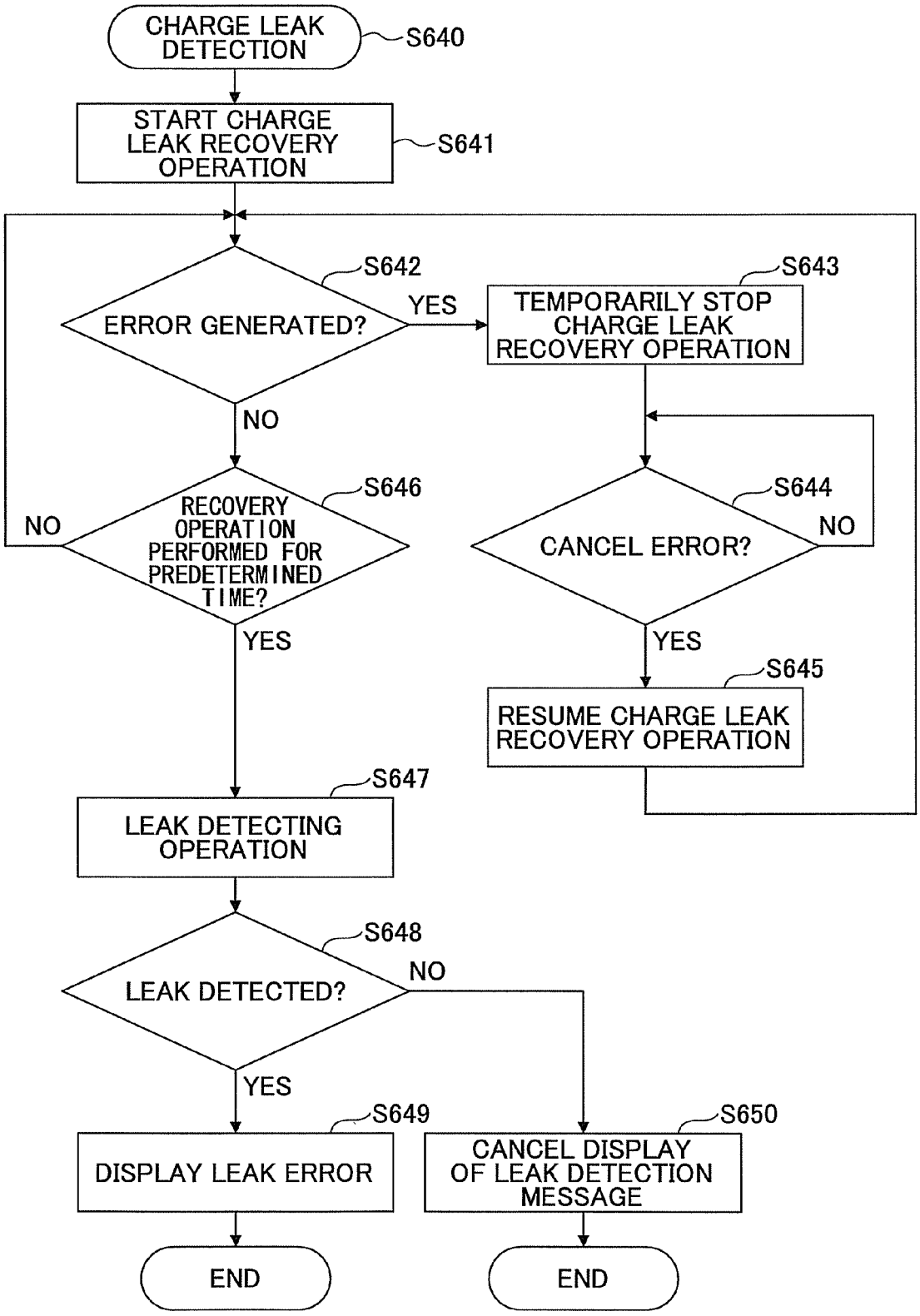
FIG. 16 is a flow chart for explaining a third example of the process of the image forming apparatus in the second embodiment.

FIG. 16 is a flow chart for explaining a third example of the process of the ink-jet recording apparatus 110 in this second embodiment. This third example of the process performs a portion of the charge leak recovery operation that was not performed due an error generated during the charge leak recovery operation, after this error generated during the charge leak recovery operation is recovered.

In FIG. 16, steps S640 through S644 correspond to the steps S610 through S614 illustrated in FIG. 14, and a description thereof will be omitted. In FIG. 16, if the judgement result in the step S644 is YES, the process advances to a step S645 which corresponds to the step S617 illustrated in FIG. 14. Hence, a portion of the charge leak recovery operation that was not performed due the error generated during the charge leak recovery operation is resumed after this error generated during the charge leak recovery operation is recovered. In other words, the charge leak recovery operation is resumed from the portion interrupted by the error. As a result, it is possible to minimize the charge error recovery operation that is performed to remove the moisture on the transport belt 51 caused by condensation.

Steps S646 through S650 illustrated in FIG. 16 correspond to the steps S618 through S622 illustrated in FIG. 14, and a description thereof will be omitted.

[Fourth Example of Process]

Figure 17:
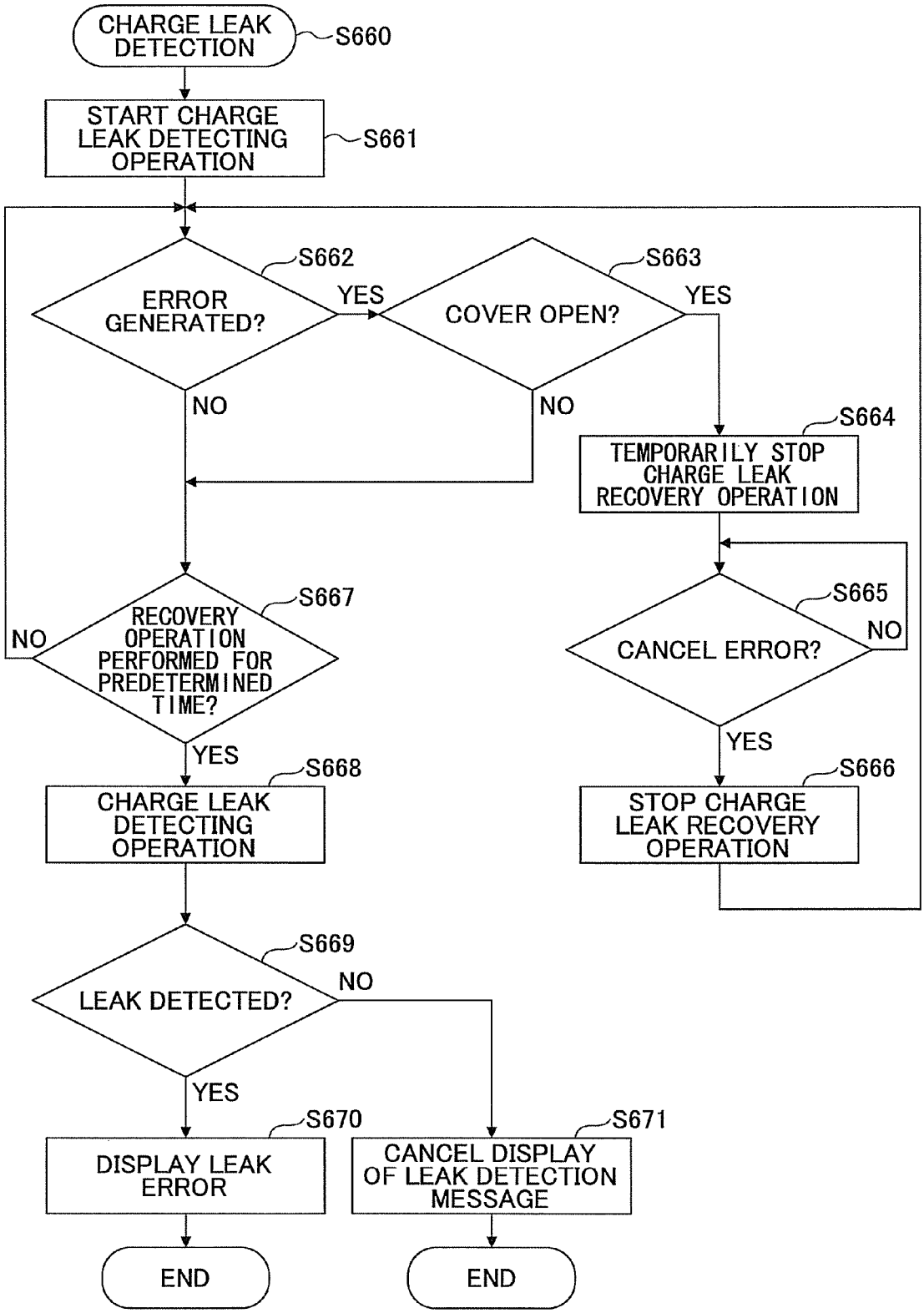
FIG. 17 is a flow chart for explaining a fourth example of the process of the image forming apparatus in the second embodiment.

FIG. 17 is a flow chart for explaining a fourth example of the process of the ink-jet recording apparatus 110 in this second embodiment. This fourth example of the process selects the charge leak recovery operation to be performed after an error generated during the charge leak recovery operation is recovered, depending on the kind of error generated during the charge leak recovery operation.

In FIG. 17, steps S660 through S662 and steps S664 through S671 correspond to steps S640 through S642 and steps S643 through S650 illustrated in FIG. 16, and a description thereof will be omitted. In FIG. 17, a step S663 is performed if the judgement result in the step S662 is YES. In the step S662, the error detecting unit 155 judges whether an error state (or an abnormal state) of the ink-jet recording apparatus 110 is detected. The error state may be generated by any kind of error which needs to be detected in the ink-jet recording apparatus 110. On the other hand, in the step S663, the error detecting unit 155 judges whether the detected error state of the ink-jet recording apparatus 110 is based on the output of the sensor which detects the open state of the lid or cover. In other words, the step S663 judges whether the lid or cover the ink-jet recording apparatus 110 is open. The process advances to the step S667 if the judgement result in the step S663 is NO, and the process advances to the step S664 if the judgement result in the step S663 is YES. Hence, the charge leak recovery operation is temporarily stopped by the step S664 only if the lid or cover is open, that is, only if the kind of error detected in the step S662 involves the open lid or cover. As a result, the interruption (or temporary stopping) of the charge leak recovery operation is determined depending on the kind of error that is detected, and it is possible to minimize the interruption time of the charge leak recovery operation.

If a plurality of sensors are provided to detect the open or closed states of a plurality of lids or covers provided on the ink-jet recording apparatus 110, the step S662 may judge if any one of the sensors detected the open state of one lid or cover. In this case, the step S663 may judge if the open lid or cover exposes a portion of the ink-jet recording apparatus 110 where the charge leak recovery operation is being carried out, that is, a portion related to the charge leak recovery operation. In this case, the interruption (or temporary stopping) of the charge leak recovery operation is determined depending on the kind of lid or cover that is open, and it is possible to minimize the interruption time of the charge leak recovery operation.

Figure 18:
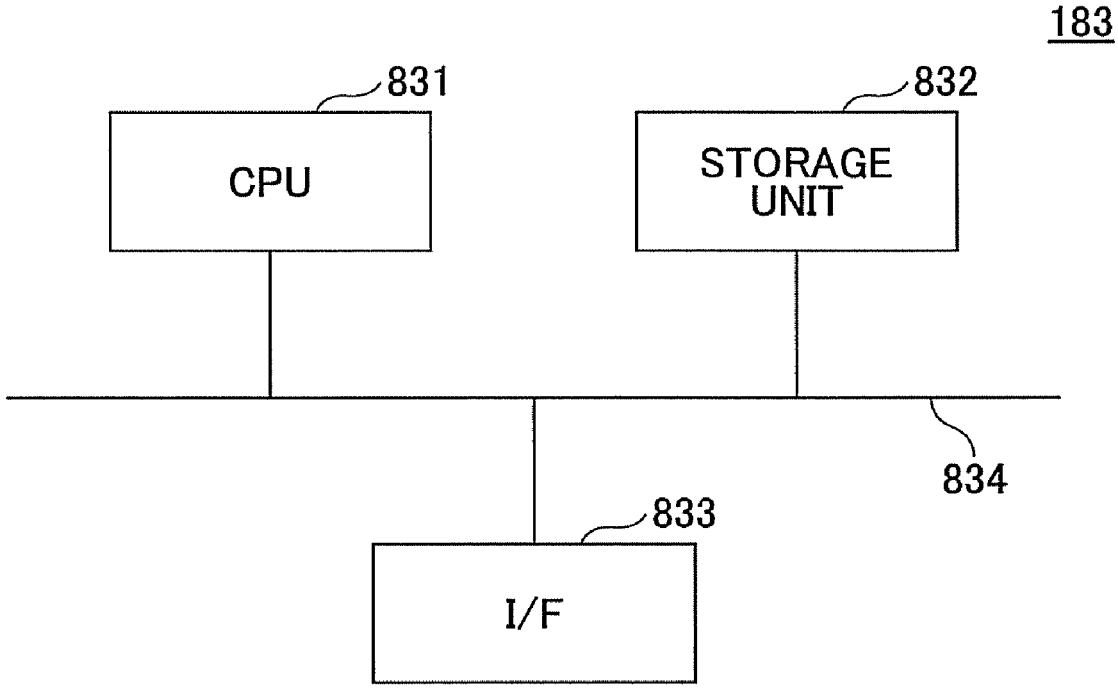
FIG. 18 is a block diagram illustrating an example of the structure of a controller.

FIG. 18 is a block diagram illustrating an example of the structure of the controller 183. The controller 183 illustrated in FIG. 18 is formed by a general-purpose computer comprising a CPU 831, a storage unit 832, and an interface (I/F) 833 that are connected via a bus 834. The storage unit 832 may be made of any suitable semiconductor memory device or, storage device using a storage medium such as a disk or, a combination of such devices. The storage unit 832 stores various data and programs to be executed by the CPU 831. The I/F 833 may provide an interface between the ink-jet recording apparatus 110 and the information processing apparatus 160, for example.

The semiconductor memory device forming the storage unit 832 or, the storage medium used in the storage device forming the storage unit 832, may form a computer-readable storage medium that stores the program which, when executed by the CPU 831, causes the CPU 831 to perform the processes of the ink-jet recording apparatus 110, including any of the processes illustrated in FIGS. 8 through 12 and FIGS. 14 through 17. In other words, the program may cause the CPU 831 to perform a process including the procedures carried out by the voltage applying unit 120, the leak detecting unit 130, the recovery operation unit 140, the recovery selecting unit 150, and the error detecting unit 155. Further, the program may be installed in the storage unit 832 from an external source, such as the information processing apparatus 160, via the network, for example.

Further, the present invention is not limited to these embodiments, but various variations and modifications may be made without departing from the scope of the present invention.

What is claimed is:

1. An image forming apparatus comprising:

a transport belt configured to transport a recording medium on a surface thereof when driven;

a voltage applying unit configured to apply a voltage to the transport belt and to charge the transport belt;

a leak judging unit configured to judge a charge leak on the surface of the transport belt;

a recovery operation unit configured to perform a charge leak recovery operation in which the transport belt is driven in a state where the voltage applying unit applies no voltage to the transport belt, when the leak judging unit judges that the charge leak is generated on the surface of the transport belt; and a recovery selecting unit configured to judge whether to accept a selection selecting the charge leak recovery operation to be performed by the recovery operation unit, wherein the leak judging unit again judges whether the charge leak is generated on the surface of the transport belt after the recovery operation unit performs the charge leak recovery operation, and wherein the recovery operation unit performs the charge leak recovery operation when the recovery selecting unit accepts the selection.

2. The image forming apparatus as claimed in claim 1, wherein the leak judging unit judges whether charge leak is generated based on an amount of current flowing in a power supply which supplies the voltage applied to the transport belt by the voltage applying unit.

3. The image forming apparatus as claimed in claim 1, wherein the recovery operation unit performs the charge leak recovery operation after a recording medium existing on the surface of the transport belt is removed, if any.

4. The image forming apparatus as claimed in claim 1 further comprising:

an input device configured to input the selection to the recovery selecting unit.

5. The image forming apparatus as claimed in claim 1, wherein the recovery selecting unit receives the selection from an external apparatus.

6. An image forming apparatus comprising:

a transport belt configured to transport a recording medium on a surface thereof when driven;

a voltage applying unit configured to apply a voltage to the transport belt and to charge the transport belt;

a leak judging unit configured to judge a charge leak on the surface of the transport belt;

a recovery operation unit configured to perform a charge leak recovery operation in which the transport belt is driven in a state where the voltage applying unit applies no voltage to the transport belt, when the leak judging unit judges that the charge leak is generated on the surface of the transport belt; and an error detecting unit configured to detect an error state of the image forming apparatus, wherein the leak judging unit again judges whether the charge leak is generated on the surface of the transport belt after the recovery operation unit performs the charge leak recovery operation, and wherein the recovery operation unit interrupts the charge leak recovery operation when the error detecting unit detects the error, and resumes the charge leak recovery operation when the error detecting unit detects no error after detecting the error.

7. The image forming apparatus as claimed in claim 6, wherein the recovery operation unit resumes the charge leak recovery operation when the error detecting unit detects no error after detecting the error, by restarting the charge leak recovery operation.

8. The image forming apparatus as claimed in claim 6, wherein the error detecting unit detects the error when an open state of a lid or cover is detected.

9. An image forming system comprising an information processing apparatus; and an image forming apparatus coupled to the information processing apparatus, said image forming apparatus comprising:

a transport belt configured to transport a recording medium on a surface thereof when driven;

a voltage applying unit configured to apply a voltage to the transport belt and to charge the transport belt;

a leak judging unit configured to judge a charge leak on the surface of the transport belt;

a recovery operation unit configured to perform a charge leak recovery operation in which the transport belt is driven in a state where the voltage applying unit applies no voltage to the transport belt, when the leak judging unit judges that the charge leak is generated on the surface of the transport belt; and a recovery selecting unit configured to judge whether to accept a selection selecting the charge leak recovery operation to be performed by the recovery operation unit, wherein the leak judging unit again judges whether the charge leak is generated on the surface of the transport belt after the recovery operation unit performs the charge leak recovery operation, wherein the recovery operation unit performs the charge leak recovery operation when the recovery selecting unit accepts the selection, and wherein the information processing apparatus sends the selection to the recovery selecting unit.

10. A non-transitory computer-readable storage medium storing a program which, when executed by a computer, causes the computer to perform a process in an image forming apparatus comprising a transport belt configured to transport a recording medium on a surface thereof when driven, said process comprising:

a voltage applying procedure applying a voltage to the transport belt and charging the transport belt;

a leak judging procedure judging a charge leak on the surface of the transport belt;

a recovery operation procedure performing a charge leak recovery operation in which the transport belt is driven in a state where the voltage applying procedure applies no voltage to the transport belt, when the leak judging procedure judges that the charge leak is generated on the surface of the transport belt; and a recovery selecting procedure judging whether to accept a selection selecting the charge leak recovery operation to be performed by the recovery operation procedure, wherein the leak judging procedure again judges whether the charge leak is generated on the surface of the transport belt after the recovery operation procedure performs the charge leak recovery operation, and wherein the recovery operation procedure performs the charge leak recovery operation when the recovery selecting procedure accepts the selection.

11. The non-transitory computer-readable storage medium as claimed in claim 10, wherein the leak judging procedure judges whether the charge leak is generated based on an amount of current flowing in a power supply within the image forming apparatus which supplies the voltage applied to the transport belt by the voltage applying procedure.

12. The non-transitory computer-readable storage medium as claimed in claim 10, wherein the recovery operation procedure performs the charge leak recovery operation after a recording medium existing on the surface of the transport belt is removed, if any.

13. A non-transitory computer-readable storage medium storing a program which, when executed by a computer, causes the computer to perform a process in an image forming apparatus comprising a transport belt configured to transport a recording medium on a surface thereof when driven, said process comprising:

a voltage applying procedure applying a voltage to the transport belt and charging the transport belt;

a leak judging procedure judging a charge leak on the surface of the transport belt;

a recovery operation procedure performing a charge leak recovery operation in which the transport belt is driven in a state where the voltage applying procedure applies no voltage to the transport belt, when the leak judging procedure judges that the charge leak is generated on the surface of the transport belt; and an error detecting procedure detecting an error state of the image forming apparatus, wherein the leak judging procedure again judges whether the charge leak is generated on the surface of the transport belt after the recovery operation procedure performs the charge leak recovery operation, and wherein the recovery operation procedure interrupts the charge leak recovery operation when the error detecting procedure detects the error, and resumes the charge leak recovery operation when the error detecting procedure detects no error after detecting the error.

14. The non-transitory computer-readable storage medium as claimed in claim 13, wherein the recovery operation procedure resumes the charge leak recovery operation when the error detecting procedure detects no error after detecting the error, by restarting the charge leak recovery operation.

15. The non-transitory computer-readable storage medium as claimed in claim 13, wherein the error detecting procedure detects the error when an open state of a lid or cover is detected.

* * * * *